US007162884B2

(12) United States Patent
Alles

(10) Patent No.: US 7,162,884 B2
(45) Date of Patent: Jan. 16, 2007

(54) VALVE MANIFOLD FOR HVAC ZONE CONTROL

(75) Inventor: Harold Gene Alles, Lake Oswego, OR (US)

(73) Assignee: Home Comfort Zones, Beaverton, OR (US)

( * ) Notice: Subject to any disclaimer, the term of this patent is extended or adjusted under 35 U.S.C. 154(b) by 187 days.

(21) Appl. No.: 10/750,709

(22) Filed: Jan. 2, 2004

(65) Prior Publication Data

US 2004/0182095 A1 Sep. 23, 2004

(51) Int. Cl.

| | |
|---|---|
| ***F25D 17/00*** | (2006.01) |
| ***F16K 11/22*** | (2006.01) |
| ***E03B 1/00*** | (2006.01) |
| ***F24D 1/00*** | (2006.01) |

(52) U.S. Cl. ..... 62/178; 137/606; 137/607; 137/597; 237/68

(58) Field of Classification Search ..... 62/178, 62/177, 186; 236/51, 49.4, 49.5; 422/103; 137/606, 607, 862, 863, 597; 237/68
See application file for complete search history.

(56) References Cited

U.S. PATENT DOCUMENTS 5,792,430 A * 8/1998 Hamper ..... 422/131
2004/0182941 A1* 9/2004 Alles ..... 236/49.3

* cited by examiner

*Primary Examiner*—Chen Wen Jiang
(74) *Attorney, Agent, or Firm*—Blakely Sokoloff Taylor & Zaffman

(57) ABSTRACT

A pressure and vacuum valve manifold system such as may be used, for example, to actuate pneumatic bladders controlling airflow in a forced air HVAC system to provide zone climate control. The valves are individually operable to connect a respective individual bladder to pressure or to vacuum. Two manifolds can be mated and commonly fed pressure and vacuum. The two manifolds can be of identical construction. One manifold chamber from each can be connected into a single large pressure manifold, and another manifold chamber from each can be connected into a single large vacuum manifold. Such connections can be made with fittings which also serve as pressure and vacuum relief valves, respectively. The valve plungers are arranged in a grid, enabling a simple X-Y two-motor servo system to actuate all the valves, one at a time. The valves may be arranged such that the valves of one manifold are one half increment offset from the valves of the other manifold, enabling a single actuator having two actuator fingers to operate only a single manifold's valve at a time.

34 Claims, 16 Drawing Sheets

FIG. 3
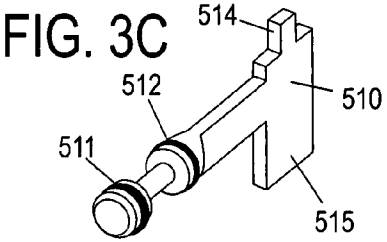
FIG. 3C
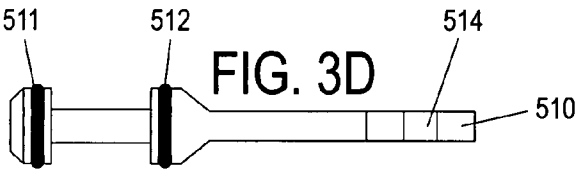
FIG. 3D
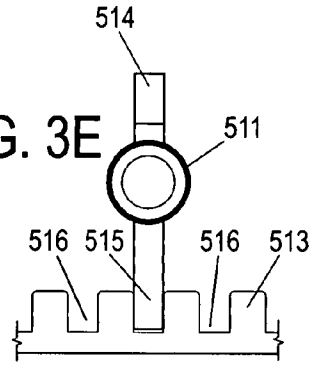
FIG. 3E
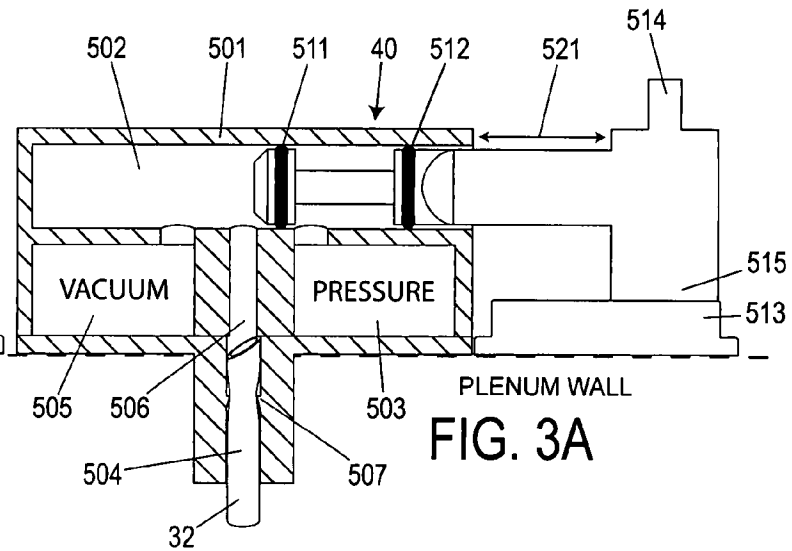
FIG. 3A
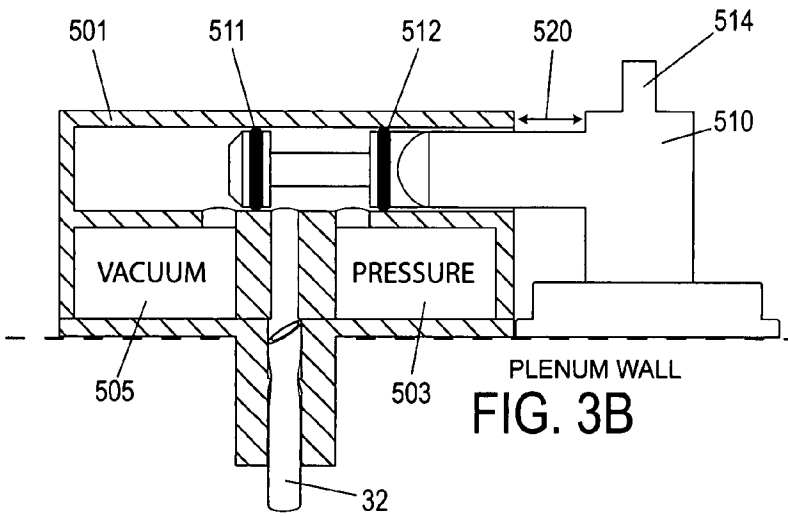
FIG. 3B 505
601
503
606
603
605
602
604
514
516
510
513

FIG. 9
FIG. 9B
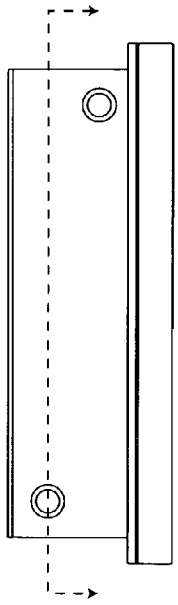
FIG. 9D
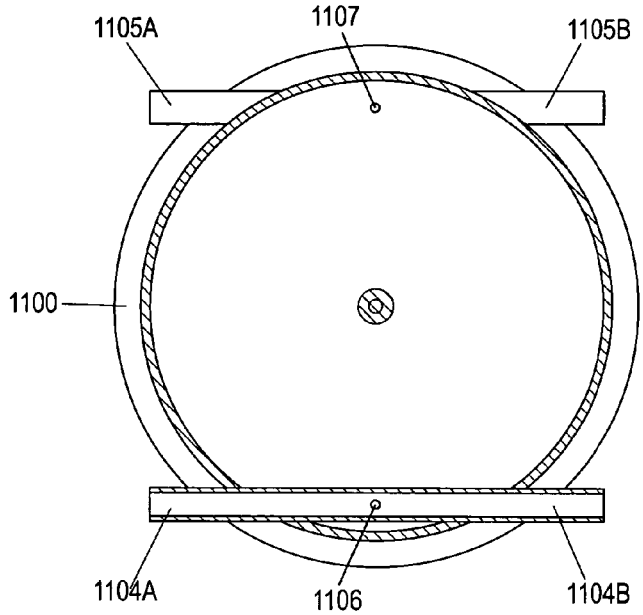
FIG. 9C
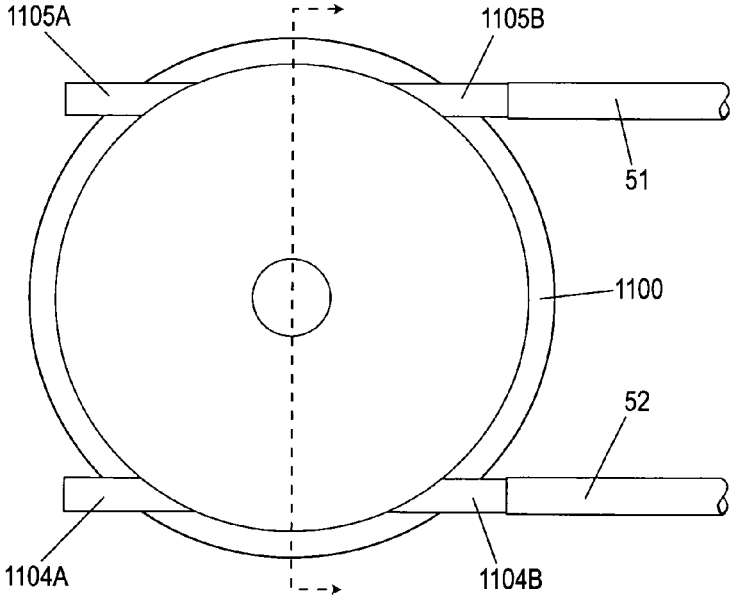
FIG. 9A
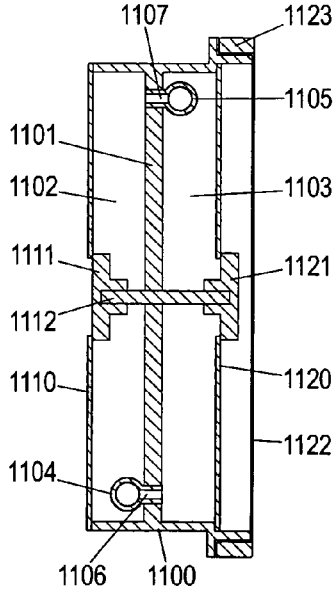

VALVE MANIFOLD FOR HVAC ZONE CONTROL

RELATED APPLICATION

This application claims benefit of the earlier filing date of co-pending application Ser. No. 10/249,198 entitled "An Improved Forced-Air Zone Climate Control System for Existing Residential Houses" filed Mar. 21, 2003 by this inventor.

BACKGROUND OF THE INVENTION

1. Technical Field of the Invention

This invention relates generally to HVAC (heating, ventilation, and air conditioning) systems, and more specifically to a valve manifold mechanism for operating duct airflow control bladders.

2. Background Art

FIG. 1 is a block diagram of a typical forced air system. The existing central HVAC unit 10 is typically comprised of a return air plenum 11, a blower 12, a furnace 13, an optional heat exchanger for air conditioning 14, and a conditioned air plenum 15. The configuration shown is called "down flow" because the air flows down. Other possible configurations include "up flow" and "horizontal flow". A network of air duct trunks 16 and air duct branches 17 connect from the conditioned air plenum 15 to each air vent 18 in room A, room B, and room C. Each air vent is covered by an air grill 31. Although only three rooms are represented in FIG. 1, the invention is designed for larger houses with many rooms and at least one air vent in each room. The conditioned air forced into each room is typically returned to the central HVAC unit 10 through one or more common return air vents 19 located in central areas. Air flows through the air return duct 20 into the return plenum 11.

The existing thermostat 21 is connected by a multi-conductor cable 73 to the existing HVAC controller 22 that switches power to the blower, furnace and air conditioner. The existing thermostat 21 commands the blower and furnace or blower and air conditioner to provide conditioned air to cause the temperature at thermostat to move toward the temperature set at the existing thermostat 21.

FIG. 1 is only representative of many possible configurations of forced air HVAC systems found in existing houses. For example, the air conditioner can be replaced by a heat pump that can provide both heating and cooling, eliminating the furnace. In some climates, a heat pump is used in combination with a furnace. The present invention can accommodate the different configurations found in most existing houses.

Pneumatic and hydraulic valve systems are well known in a variety of industries. Most valve systems comprise only a single valve which is actuated to control the flow of a single fluid under pressure or vacuum. Most valve systems are, essentially, binary switches, such as a pneumatic valve which selectively fully couples or fully decouples a tire inflation chuck from an air pressure source such as a pressurized tank. Other valve systems provide a more analog control, such as a hydraulic control valve which enables a heavy equipment operator to provide a variety of pressures or flows of hydraulic fluid from a (single pressure) high pressure supply pump to a hydraulic ram actuating an articulating bucket or other such component. Still other valve systems include a battery of plural valves, each controlling the flow of a respective individual fluid, such as a multi-beverage fountain dispenser from which a consumer can retrieve any of a variety of soft drinks from respective ones of a variety of nozzles. In this latter instance, the individual valves not only control the flow of their respective soft drink syrups, but they are each also coupled to a common carbonated water supply.

What is not available, however, is a valve manifold which enables individual valves to be operated to each independently select between two or more fluid flows.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 3 shows, in cross-section, one air valve of a plurality of servo-controlled air valves according to one embodiment of this invention.

FIG. 9 shows one embodiment of the pressure and vacuum relief valves.

DETAILED DESCRIPTION

Overview of the System

Figure 1:
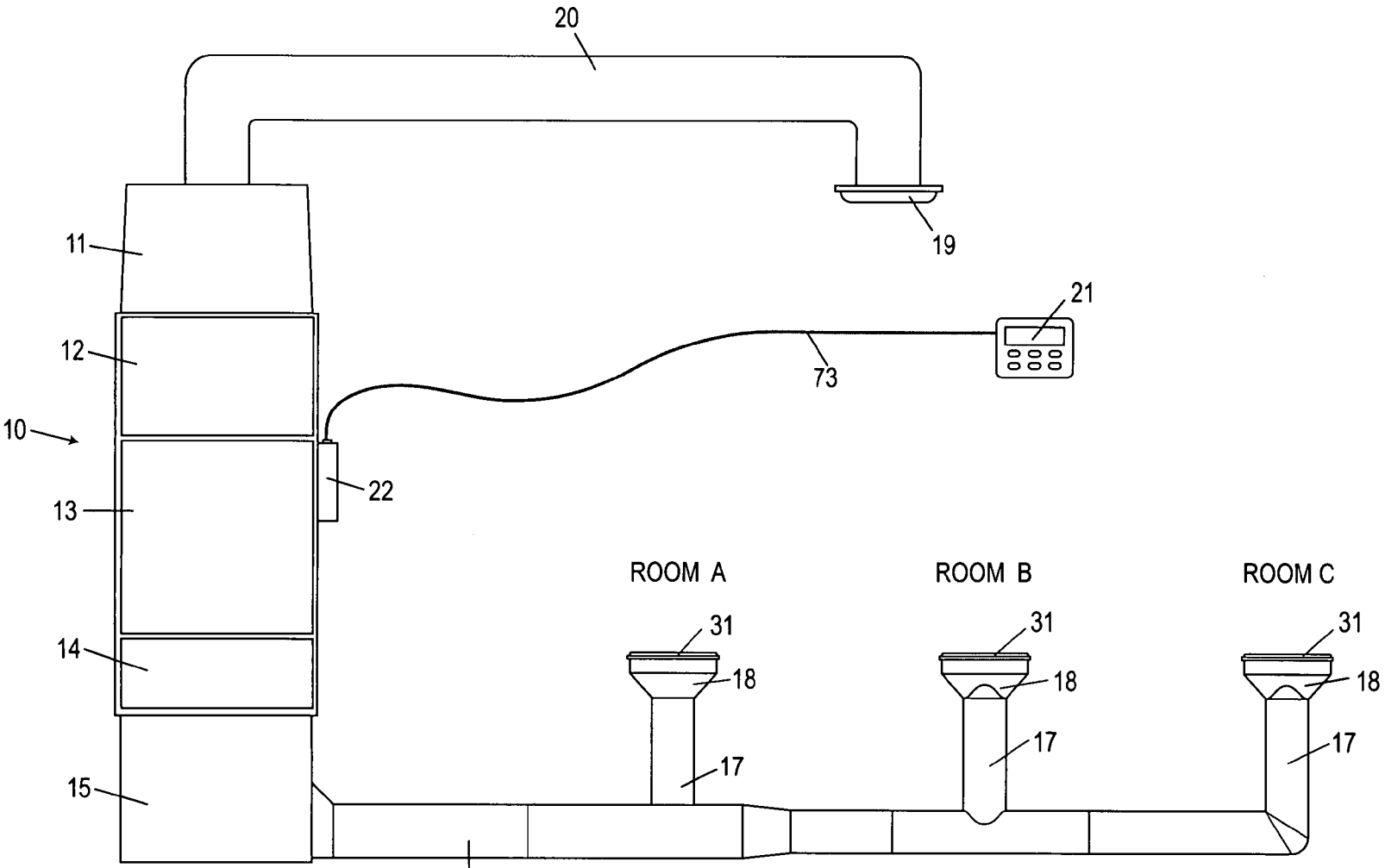
FIG. 1 prior art
FIG. 1 shows a typical forced air residential HVAC system.
Figure 2:
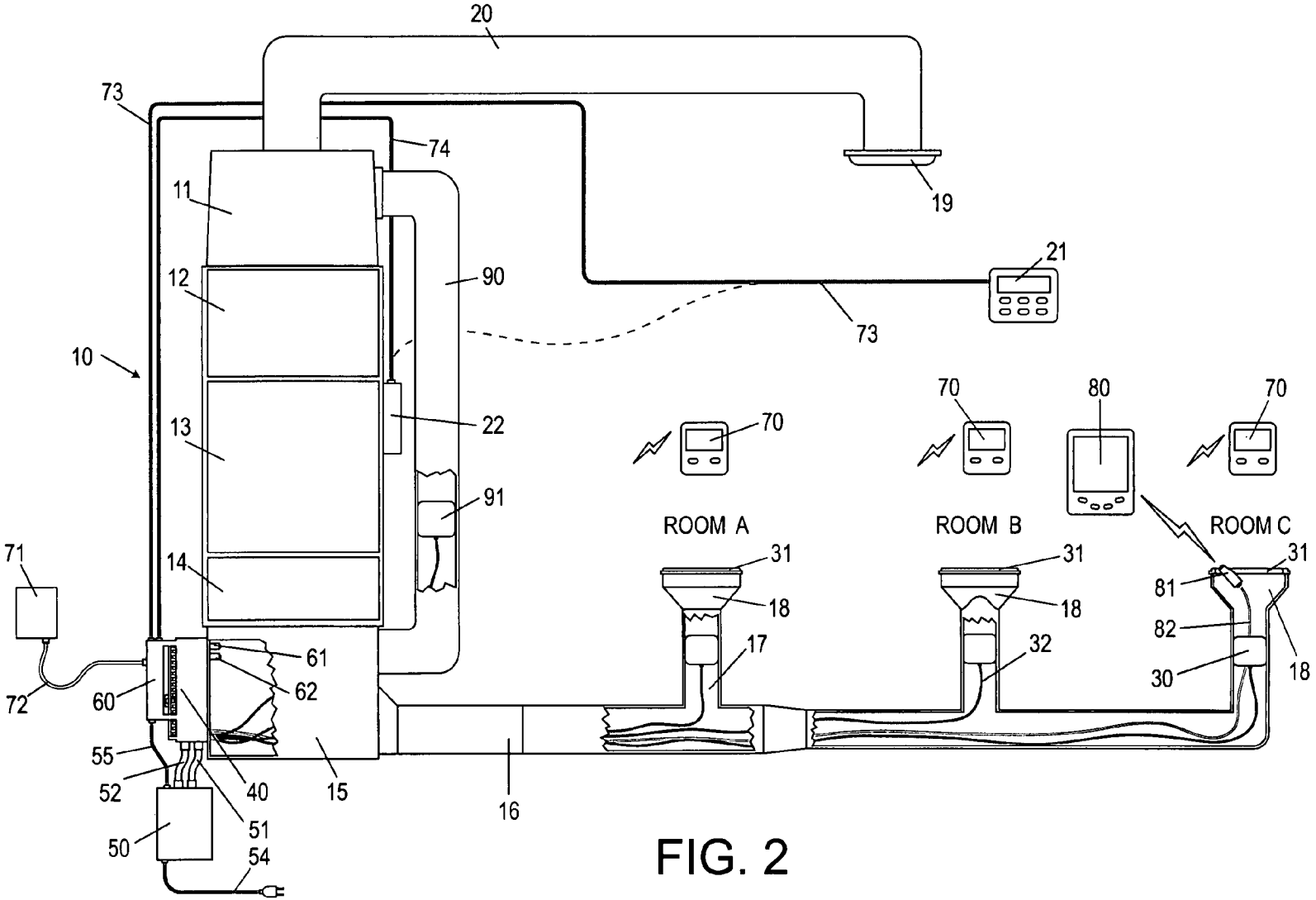
FIG. 2 shows the present invention installed in the HVAC system illustrated in FIG. 1.

FIG. 2 is a block diagram of the present invention installed in an existing forced air HVAC system as shown in FIG. 1. The airflow through each vent is controlled by an airtight bladder 30 mounted behind the air grill 31 covering the air vent 18. The bladder is either fully inflated or deflated while the blower 12 is forcing air through the air duct 17. A small air tube 32 (~0.25" OD) is pulled through the existing air ducts to connect each bladder to one air valve of a plurality of servo controlled air valves 40 mounted on the side of the conditioned air plenum 15. There is one air valve for each bladder. A small air pump in air pump enclosure 50 provides a source of low-pressure (~1 psi) compressed air and vacuum at a rate of ~1.5 cubic feet per minute. The pressure air tube 51 connects the pressurized air to the air valves 40. The vacuum air tube 52 connects the vacuum to the air valves 40. The air pump enclosure 50 also contains a 5V power supply and control circuit for the air pump. The AC power cord 54 connects the system to 110V AC power. The power and control cable 55 connect the 5V power supply to the control processor and servo controlled air valves and connect the control processor 60 to the circuit that controls the air pump. The control processor 60 controls the air valve servos 40 to set each air valve to one of two positions. The first position connects the compressed air to the air tube so that the bladder inflates. The second position connects the vacuum to the air tube so that the bladder deflates.

A wireless thermometer 70 is placed in each room in the house. All thermometers transmit, on a shared radio frequency of 433 MHz, packets of digital information that encode 32-bit digital messages. A digital message includes a unique thermometer identification number, the temperature, and command data. Two or more thermometers can transmit at the same time, causing errors in the data. To detect errors, the 32-bit digital message is encoded twice in the packet. The radio receiver 71 decodes the messages from all the thermometers 70, discards packets that have errors, and generates messages that are communicated by serial data link 72 to the control processor 60. The radio receiver 71 can be located away from the shielding effects of the HVAC equipment if necessary, to ensure reception from all thermometers.

The control processor 60 is connected to the existing HVAC controller 22 by the existing HVAC controller connection 74. The control processor 60 interface circuit uses the same signals as the existing thermostat 21 to control the HVAC equipment. The existing thermostat connection 73 is also connected to the control processor 60 interface circuit that includes a manual two position switch. In the first switch position, the HVAC controller 22 is connected to the control processor 60. In the second switch position, the HVAC controller is connected to the existing thermostat 21. The existing thermostat 21 is retained as a backup temperature control system.

The control processor 60 controls the HVAC equipment and the airflow to each room according to the temperature reported for each room and according to an independent temperature schedule for each room. The temperature schedules specify a heat-when-below-temperature and a cool-when-above-temperature for each minute of a 24-hour day. A different temperature schedule can be specified for each day for each room. These temperature schedules are specified by the occupants using an interface program operating on a standard PDA (personal data assistant) 80. PDAs are available from several manufacturers such as Palm. The interface program provides graphical screens and popup menus that simplify the specification of the temperature schedules and the assignment of schedules to rooms for the days of the week and for other special dates. The PDA 80 includes a standard infrared communications interface called IrDA that is used to communicate with the control processor 60. The IrDA link 81 is mounted in the most convenient air vent 18, behind its air grill 31. The IrDA link 81 has an infrared transmitter and receiver mounted so that it can communicate with the PDA 80 using infrared signals though the air grill. The IrDA link 81 is connected to the control processor 60 by the link connection 82 that is pulled through the air duct with the air tube to that air vent. After changes are made to the temperature schedules, the PDA 80 is pointed toward the IrDA link 81 and the standard IrDA protocol is used to exchange information between the PDA 80 and the control processor 60.

The IrDA link 81 also has an audio alarm and light that are controlled by the control processor 60. The control processor can sound the alarm and flash the light to get the attention of the house occupants if the zone control system needs maintenance. The PDA 80 is used to communicate with the control processor 60 to determine specific maintenance needs.

The present invention can set the bladders so that all of the airflow goes to a single air vent, thereby conditioning the air in a single room. This could cause excessive air velocity and noise at the air vent and possibly damage the HVAC equipment. This is solved by connecting a bypass air duct 90 between the conditioned air plenum15 and the return air plenum 11. A bladder 91 is installed in the bypass 90 and its air tube is connected to an air valve 40 so that the control processor can enable or disable the bypass. The bypass provides a path for the excess airflow and storage for conditioned air. The control processor 60 is interfaced to a temperature sensor 61 located inside the conditioned air plenum 15. The control processor monitors the conditioned air temperature to ensure that the temperature in the plenum 15 does not go above a preset temperature when heating or below a preset temperature when cooling, and ensures that the blower continues to run until all of the heating or cooling has been transferred to the rooms. This is important when bypass is used and only a portion of the heating or cooling capacity is needed, so the furnace or air conditioner is turned only for a short time. Some existing HVAC equipment has two or more heating or cooling speeds or capacities. When present, the control processor 60 controls the speed control and selects the speed based on the number of air vents open. This capability can eliminate the need for the bypass 90.

A pressure sensor 62 is mounted inside the conditioned air plenum 15 and interfaced to the control processor 60. The plenum pressure as a function of different bladder settings is used to deduce the airflow capacity of each air vent in the system and to predict the plenum pressure for any combination of air valve settings. The airflow to each room and the time spent heating or cooling each room is use to provide a relative measure of the energy used to condition each room. This information is reported to the house occupants via the PDA 80.

This brief description of the components of the present invention installed in an existing residential HVAC system provides an understanding of how independent temperature schedules are applied to each room in the house, and the improvements provided by the present invention. The following discloses the details of each of the components and how the components work together to proved the claimed features.

Servo Controlled Air Valves

FIG. 3 shows several views of one air valve of a plurality of servo controlled air valves 40. The preferred embodiment has two valve blocks made of plastic using injection molding. Each valve block is approximately 1"×2"×7" and contains valve cylinders for 12 valves.

FIG. 3A is a cross section view of one valve block 501 sectioned through one of the valve cylinders 502. Each valve cylinder is 0.375" in diameter and approximately 1.875" deep. Each valve cylinder has three holes (~0.188") that connect the cylinder to the pressure cavity 503, the valve header 504 (shown in cross section), and the vacuum cavity 505. The valve header 504 connects the air tube 32 (shown in full view) to the valve cylinder and provides one side of the pressure and vacuum cavities in the valve block. The valve header is made of plastic using injection molding and is glued to the valve block to form airtight seals. The air tube 32 is press fit into the air tube hole 506 in the valve header. The inside of the air tube hole has a one-way compression edge 507 making it difficult to pull the air tube from the header after it has been inserted. The valve block is mounted on a side of the conditioned air plenum 15 so that the portion of valve header 504 connecting to the air tube is inside the plenum and the portion of the valve header sealing the pressure and vacuum cavities and the valve block 501 are outside the plenum.

FIG. 3C is a perspective view of the valve slide 510 and FIG. 3D is a top view of the same valve slide. The valve slide has grooves for O-ring 511 and O-ring 512. The valve slide has a valve lever 514 that protrudes above the valve plate 515. The valve lever is used to move the valve slide inside the valve cylinder.

FIG. 3A and FIG. 3B represent the same air valve in two different positions. The valve slide 510 (shown in full view) fits snugly inside the valve cylinder 502 so that the O-rings seal the cavities formed by the cylinder wall and the valve slide. The slide valve has two resting positions, the pressure position 520 shown in FIG. 3B and the vacuum position 521 shown in FIG. 3A. The air pump 50 is turned on only when the valves are in one of these two positions. The air pump is off while the valves are moved. Referring to FIG. 3B, when the slide valve is in the pressure position 520, O-ring 511 seals the vacuum cavity and the valve cylinder from the air tube. The cavity formed between O-ring 511 and O-ring 512 connects the pressure cavity to the air tube so pressurized air will flow through the air tube to inflate the bladder. O-ring 512 seals the valve cylinder from the outside air. Referring to FIG. 3A, when the slide valve is in the vacuum position 521, the vacuum cavity is connected to the air tube and O-ring 511 seals the vacuum cavity from the pressure cavity. The bladder is deflated as air flows through the air tube towards the vacuum created by the air pump. O-ring 511 and O-ring 512 seal the pressure cavity from the air tube and outside air. The valve slide is moved to either the pressure position 520 or the vacuum position 521 by a servo that engages the valve lever 514.

FIG. 3E shows an end view of a valve slide as positioned when in a valve cylinder. The valve lever 514 and valve plate 515 are constrained from rotating about the valve cylinder axis by a slot 516 in the valve constraint 513. The valve constraint has a slot 516 for each valve slide. FIG. 3A also shows a side view of the valve plate 515 and the valve constraint 513.

Figures 4, 4A, 4B, 4C, 4D, 4E, 4F:
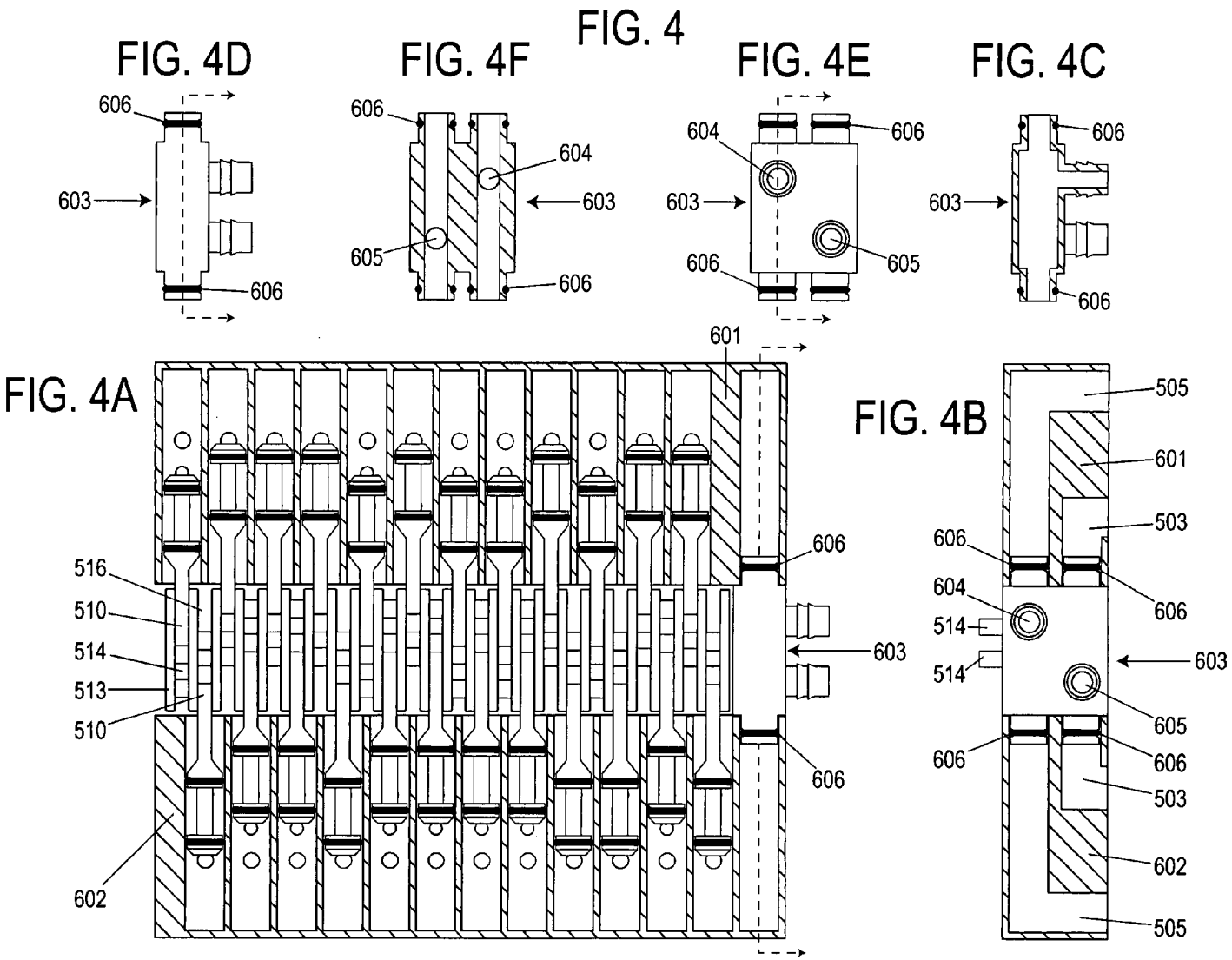
FIG. 4 shows two blocks of air valves and a connecting air-feed tee according to one embodiment of this invention.

FIG. 4 shows several views of the two valve blocks 601 and 602 and air-feed tee 603.

FIG. 4A is a cross-section view through the axis of the valve cylinders of valve block 601 and valve block 602 positioned so that the valve slides 510 (shown in full view) are interleaved. Interleaving minimizes the spacing between valve slides and aligns the valve levers 514 so the valve servo can move the valve slides in valve blocks 601 and 602. Some of the valve slides are shown in the pressure position and the others are shown in the vacuum position. The valve constraint 513 has 24 slots 516 that engage the 24 valve slide plates to prevent rotation of the valve slides about the valve cylinder axis. The ends of the valve blocks 601 and 602 have passageways from the pressure and vacuum cavities to the air-feed tee 603. O-rings 606 seal the connections between the air-feed tee and these passageways.

Figures 6, 6A, 6B, 6C:
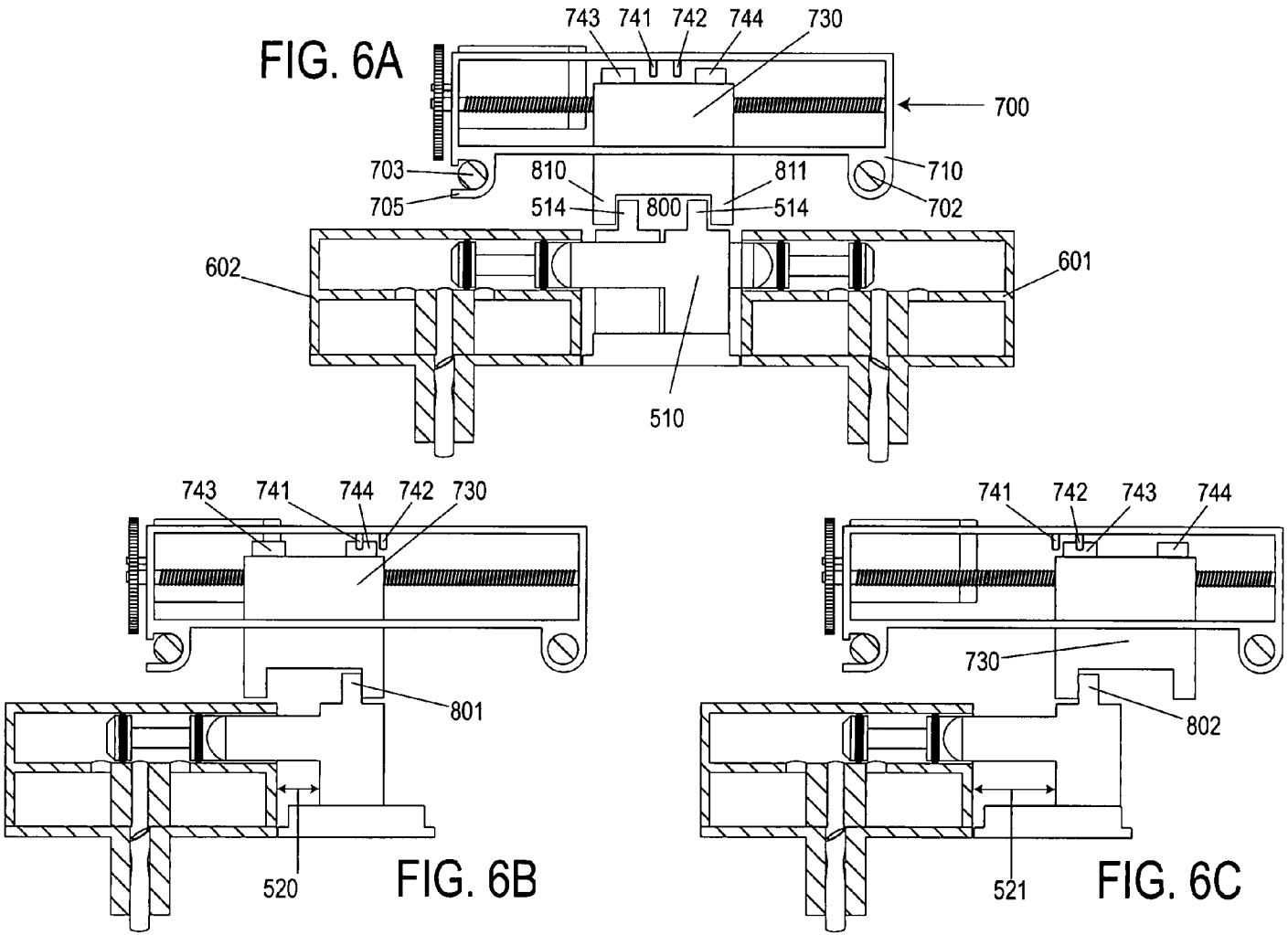
FIG. 6 shows the valve servo positioned over one of the air valves.

FIG. 4B is an end cross-section view through the section line shown in FIG. 6A of the passageways in the valve blocks 601 and 602 to the pressure cavities 503 and vacuum cavities 505. The air-feed tee 603 is shown in full view. Four O-rings 606 seal the air-feed tee to the valve blocks. The air-feed tee has a vacuum connection 604 that connects to the vacuum air tube 52 and a pressure connection 605 that connects to the pressure air tube 51. The valve levers 514 protrude beyond the surface of the valve blocks.

FIG. 4D is a top view of the air-feed tee 603 and o-rings 606 in isolation from the valve blocks. FIG. 4C is a cross-section view (through the section line shown in FIG. 4E) of the air-feed tee and the vacuum connection 604. FIG. 4E is a front view of the air-feed tee in isolation. FIG. 4F is a cross-section view (through the section line shown in FIG. 4D) of the air-feed tee through the center of the passageways connecting to the pressure and vacuum cavities.

Figure 5:
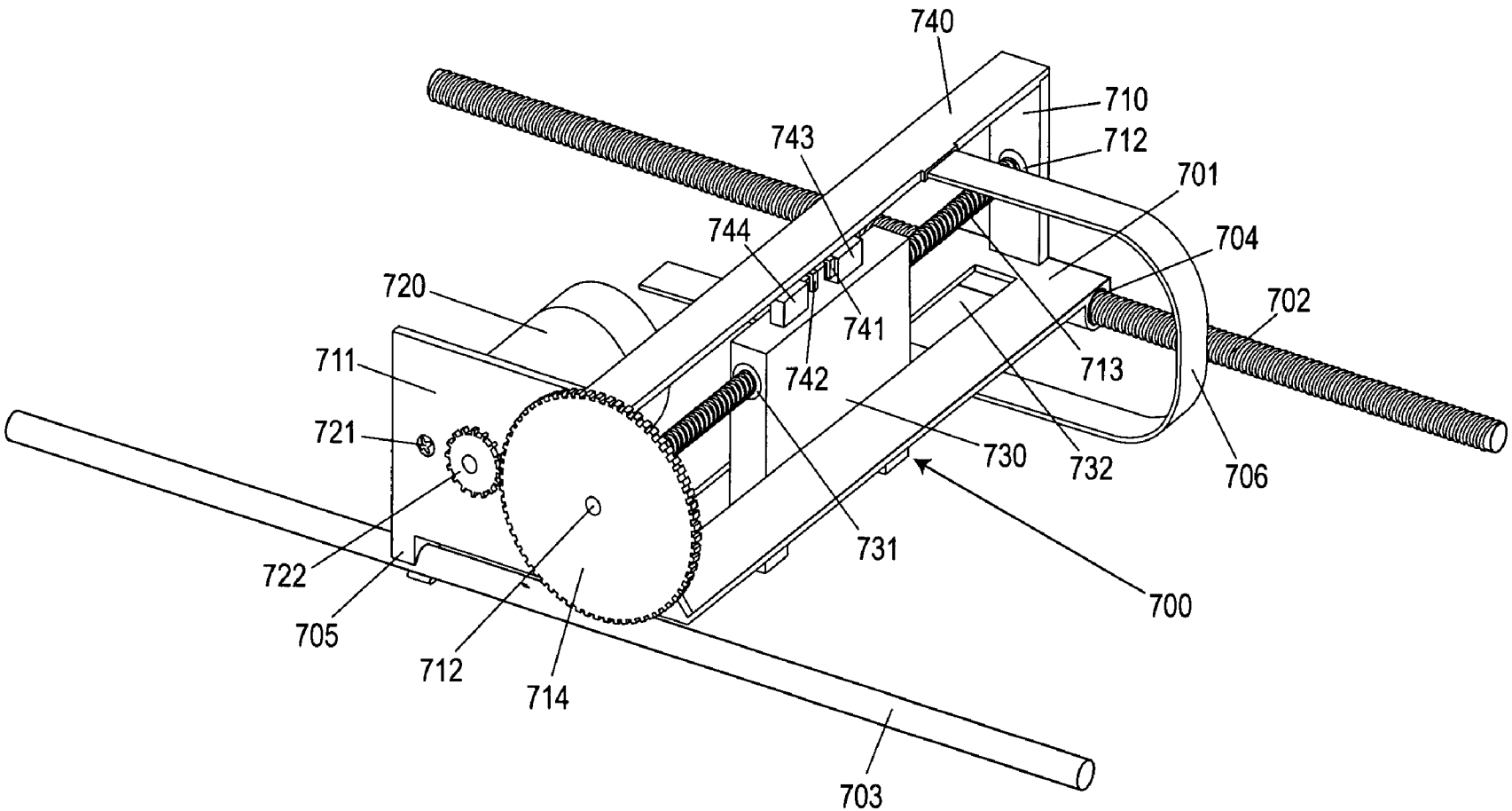
FIG. 5 shows one embodiment of a valve servo according to this invention.

FIG. 5 is a perspective drawing of the valve servo 700. The servo carriage 701 is made of injection molded plastic. The servo carriage is supported by the position threaded rod 702 and the slide rod 703. In the preferred embodiment, the position threaded rod is ⅜" in diameter and has 16 threads per inch. The servo carriage has a position threaded bearing 704 that engages the position threaded rod. The position threaded bearing may be a threaded hole machined in the valve carriage plastic, or may be a threaded metal cylinder press fit into a hole in the servo carriage. The fit between the position threaded rod and the position threaded bearing is loose so there is minimum friction as the threaded rod rotates to move the servo carriage. The interface between the threaded rod and the threaded bearing provides support and constraint for the servo carriage for all directions except rotation about the axis of the threaded rod. Rotation constraint is provided by the smooth slide rod 703 that engages the carriage guide 705. The fit between the slide rod and the carriage guide is loose so there is minimum friction as the carriage is moved by rotation of the position threaded rod.

The servo carriage has a bearing post 710 and a bearing plate 711 that support the two valve bearings 712. The valve bearings are press fit into holes molded in the bearing post and bearing plate. The valve threaded rod 713 is a standard #8 sized screw with 32 threads per inch. The ends of the valve threaded rod are machined to fit the valve bearings so the rod can rotate with minimum friction and constrained so it can not move in any other way. The valve drive spur gear 714 is approximately 1" in diameter and is fastened to the end of the valve threaded rod.

The valve motor 720 is mounted on the bearing plate 711 by two screws 721 (one screw 721 is hidden by spur gear 714) that pass through the bearing plate into the end of the motor. The valve motor spur gear 722 is approximately 3/16" in diameter and is fastened to the shaft of the valve motor. The valve motor is positioned so that the valve motor spur gear engages the valve drive spur gear. The valve motor operates on 5 volts DC using approximately 0.3 A. It rotates CW or CCW depending on the direction of current flow. The control processor 60 has an interface circuit that enables it to drive the valve motor CW or CCW at full power. The control is binary on or off. The valve motor, valve motor spur gear, and valve drive spur gear are chosen so that the valve threaded rod rotates approximately 1000 RPM when the valve motor is driven.

The servo slider 730 has a slider threaded bearing 731 that engages the valve threaded rod 713. The servo slider is supported by the valve threaded rod and is constrained by the threaded rod in all directions except rotation about the axis of the threaded rod. The servo slider passes through the slider slot 732 in the servo carriage. The slider slot constrains the servo slider so that as the valve threaded rod rotates, the servo slider can only move parallel to the axis of the slot and the axis of the valve threaded rod. The fit between the servo slider and the slider slot is loose to minimize friction as the slider moves.

The bearing post 710 and bearing plate 711 also support the valve PCB (printed circuit board) 740. The valve PCB connects to a 6-conductor flat flexible cable 706 that connects to the interface circuit of the control processor 60. Two wires from the valve motor connect to PCB 740 and to two conductors in the flexible cable. The valve PCB supports the A-photo-interrupter 741 and the B-photo-interrupter 742. The photo-interrupters are positioned so that A-slider tab 743 and B-slider tab 744 on the servo slider 730 pass through the photo-interrupters as the servo slider is moved by the valve motor and valve threaded rod. The photo-interrupters generate binary digital signals that encode three positions of the of the servo slider. These digital signals are connected to the control processor through the flexible cable and are used by the control processor when driving the valve motor to position the servo slider.

FIG. 6 shows three views of the valve servo positioned over the valve blocks. FIG. 6A shows the valve blocks 601 and 602 in cross-section with the valve servo 700 positioned over one of the valve slides 510 in valve block 602. The position of the valve servo is established by the position threaded rod 702, position threaded rod bearing 704, slide rod 703, and carriage guide 705. The servo slider 730 is shown in the center position 800. A-slider finger 810 and B-slider finger 811 have about 1/16" clearance from any of the valve levers 514 in either the pressure position 520 or the vacuum position 521. Both valve sliders are shown in the vacuum position. The A-photo-interrupter 741 and the B-photo-interrupter 742 are positioned so that neither the A-slider tab 743 nor the B-slider tab 744 interrupt the light path in the photo-interrupters when the servo slider is in the center position 800. This is the only position where both photo-interrupters are uninterrupted.

FIG. 6B shows the servo slider in the B-position 801 corresponding to the pressure position 520 of the valve slide. In this position, the B-slider tab 744 interrupts the A-photo-interrupter 741 while the light path of the B-photo-interrupter is uninterrupted. When moving from the center position 800 to the B-position, both photo-interrupters are interrupted by the B-slider tab. To move the valve to the B-position, the control processor drives the valve motor until the light path of the B-photo-interrupter is uninterrupted. To return to the center position 800, the valve motor direction is reversed and driven until both photo-interrupters are uninterrupted.

FIG. 6C shows the servo slider in the A-position 802 corresponding to the vacuum position 521 of the valve slide. In this position, the A-slider tab 743 interrupts the B-photo-interrupter 742 while the light path of the A-photo-interrupter 741 is uninterrupted. When moving from the center position 800 to the A-position, both photo-interrupters are interrupted by the A-slider tab. To move the valve to the A-position, the control processor drives the valve motor until the light path of the A-photo-interrupter is uninterrupted. To return to the center position 800, the motor direction is reversed and driven until both photo-interrupters are uninterrupted.

When the control processor begins operation, the position of the valve servo is unknown, and must be initialized. The valve servo is initialized first by testing the signals from the A- and B-photo-interrupters. If both are uninterrupted, then the valve servo is in the center position 800 and properly initialized. Any other combination of signals from the photo-interrupters represents one of two possible positions.

If both photo-interrupters are interrupted, then either the A-slider tab 743 or the B-slider tab 744 is interrupting the light paths. For this case, the servo slider is driven towards the B-position 801 until the B-photo-interrupter becomes uninterrupted. The servo slider either is in the B-position or is just right of the center position. After a pause for the valve motor to come to a stop, the servo slider is driven towards the B-position again. If the A-photo-interrupter becomes uninterrupted within a short time, the servo slider is in the center position, and the valve servo is initialized. If the A-photo-interrupter remains interrupted, then the servo slider is jammed in the B-position and must be driven towards the A-position until both photo-interrupters are uninterrupted.

If initially only the A-photo-interrupter is interrupted, then the servo slider either is in the B-position 801 or is slightly right of the center position. The servo slider is driven towards the B-position and if the A-photo-interrupter becomes uninterrupted within a short time, the servo slider is in the center position, and the valve servo is initialized. If the A-photo-interrupter remains interrupted, then the servo slider is jammed in the B-position and must be driven towards the A-position until both photo-interrupters are uninterrupted.

If initially only the B-photo-interrupter is interrupted, then the servo slider either is in the A-position 802 or is slightly left of the center position. The servo slider is driven towards the A-position and if the B-photo-interrupter becomes uninterrupted within a short time, the servo slider is in the center position, and the valve servo is initialized. If the B-photo-interrupter remains interrupted, then the servo slider is jammed in the A-position and must be driven towards the B-position until both photo-interrupters are uninterrupted.

Figure 7:
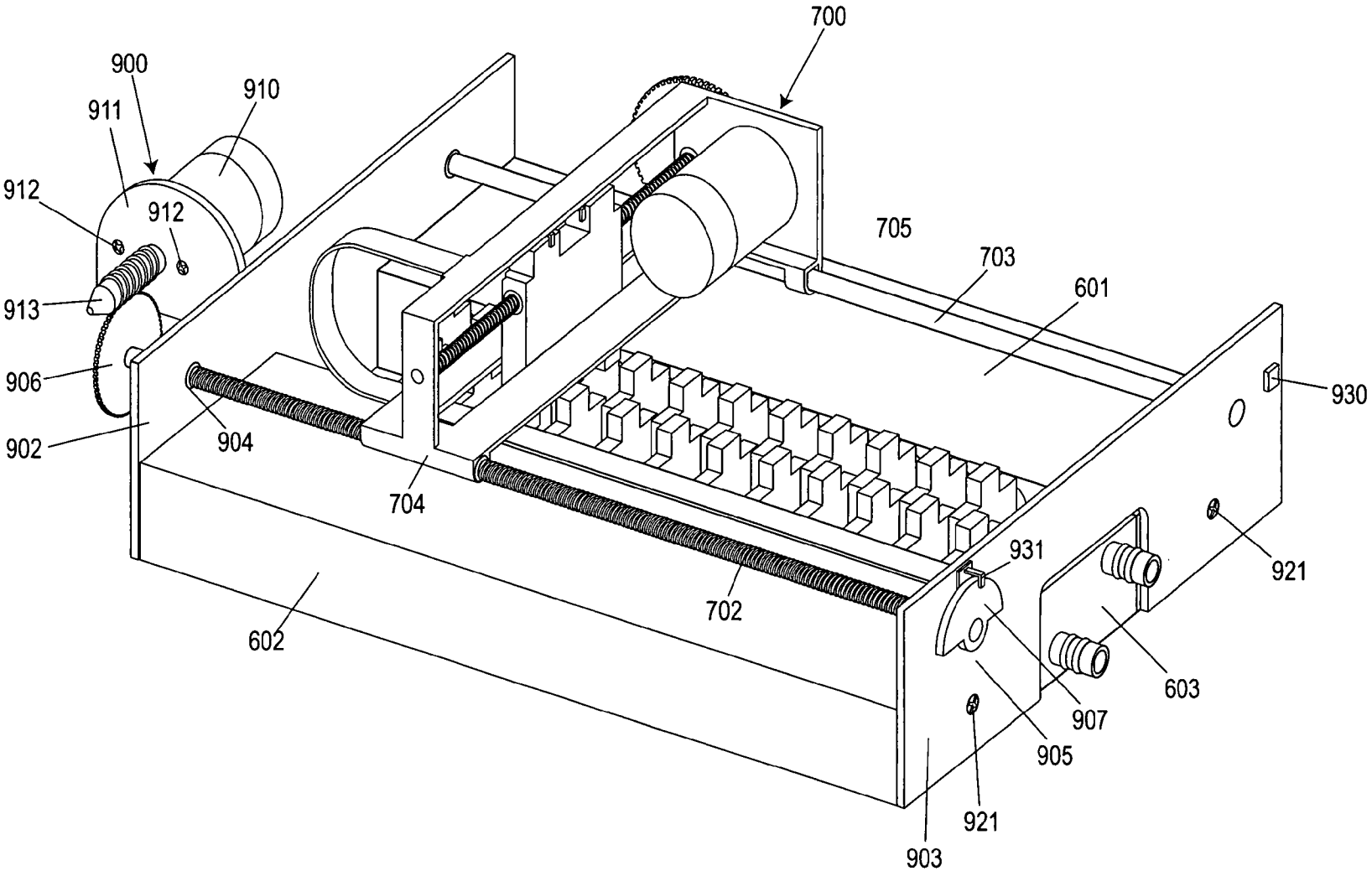
FIG. 7 shows one embodiment of the position servo.

FIG. 7 is a perspective drawing of the position servo 900 assembled with valve block 601 and valve block 602. The position bearings 904 and 905 are press fit into holes in the motor bracket 902 and bearing bracket 903. The position threaded rod 702 is machined to fit in the bearings and to constrain the threaded rod so that the only possible movement is rotation. The threaded rod is also machined so that the rotation cam 907 can be fastened to the end that protrudes beyond position bearing 905 and so that the position spur gear 906 can be fastened to the end that protrudes beyond position bearing 904. The slide rod 703 is press fit into holes in the motor bracket and the bearing bracket. The bearing holes and the slide rod holes are positioned so that the position threaded rod and the slide rod are parallel to each other and to the valve blocks. The position threaded bearing 704 of the valve servo 700 engages the position threaded rod and the carriage guide 705 engages the slide rod 703. The position motor 910 is attached with two screws 912 to the motor plate 911, which is injection molded as part of the motor bracket 902. The position motor is positioned so that the position worm gear 913 engages the position spur gear 906.

Motor bracket 902 is attached to the valve block using screws. The motor bracket has molded spacers in line with the screw holes so that when attached, the motor bracket is perpendicular to the valve blocks and spaced so that the servo slider can be positioned over the air valve closest to the motor bracket. Likewise bearing bracket 903 is attached to the valve blocks using screws 921. The bearing bracket has molded spacers in line with the screw holes so that when attached, the bearing bracket is perpendicular to the valve blocks and spaced so that the servo slider can be positioned over the air valve closest to the bearing bracket. The bearing bracket has a cutout at the bottom center so that the pressure air tube 51 and the vacuum air tube 52 can be attached to the air-feed tee 603. The combination of the motor bracket, bearing bracket, and valve bank 601 and 602 connected together with screws form a rigid structure that is mounted as a single unit.

The position motor operates on 5 volts DC using approximately 0.5A. It rotates CW or CCW depending on the direction of current flow. The control processor 60 has an interface circuit that enables it to drive the position motor CW or CCW at full power. The control is binary on or off. The EOT (end of travel) photo-interrupter 930 is mounted on the bearing bracket 903 so that the carriage guide 705 interrupts the light path when the valve servo is positioned over the valve slide 510 closest to the bearing bracket. The binary digital signal from the EOT photo-interrupter is interfaced to control processor 60. The rotation photo-interrupter 931 is mounted on the bearing bracket 903 and is positioned so that the rotation cam 907 interrupts the light path about 50% of the time as the position threaded rod rotates. For ½ of a rotation, the light path is interrupted and is uninterrupted for the other part of a rotation. The binary digital signal from the rotation photo-interrupter is interfaced to the control processor.

When the control processor begins operation, the position of the valve servo carriage is unknown and must be initialized. If the EOT photo-interrupter is uninterrupted, the position servo is driven to move the valve servo carriage towards the bearing bracket until the EOT photo-interrupter's light path is interrupted by the carriage guide. The EOT photo-interrupter is positioned so that when the position motor stops, the servo slider 730 is positioned over the valve slide closest to the bearing bracket. If the EOT photo-interrupter is initially interrupted, the exact position of the valve servo carriage is not known. Therefore, the position servo is driven to move the valve servo away from the bearing bracket until the EOT photo-interrupter is uninterrupted. Then the position servo is driven to move the valve servo towards the bearing bracket until the EOT photo-interrupter is interrupted, just as if the EOT photo-interrupter was initially uninterrupted.

After the valve and position servos are initially positioned, the control processor can set the air valves by controlling the position and valve motors. Beginning with the air valve closest to the bearing bracket, the control processor moves the servo slider to either the A-position or the B-position to set the valve slider to the pressure position or the vacuum position. Then the servo slider is returned to the center position. Then the position servo is driven to move the valve servo so it is positioned over the second air valve. The position threaded rod has 16 threads per inch and the valve slides are spaced ¼" center to center. Therefore, four revolutions of the threaded rod move the valve servo a distance equal to the distance between adjacent valve slides. The control processor monitors the rotation photo-interrupter 931 while the position threaded rod rotates, counting the number of transitions from interrupted to uninterrupted. After four such transitions, the position motor is stopped. Then the valve servo is drive to set the next valve, and after returning to the center position, the position motor drives the position threaded rod for four more revolutions. This cycle is repeated until all 24 valves are set. The preferred embodiment of the servo controlled valves requires less then one minute to set the positions of all 24 air valves.

After twenty-four air valves are set, the valve servo is positioned over the air valve closest to the motor bracket. The next time the valves are set, the position servo moves the valve servo toward the bearing bracket. The valve servo position is re-initialized by using the EOT photo-interrupter to set the position for the air valve closest to the bearing bracket. This ensures any errors in counting rotations are corrected every other cycle of setting air valves.

Air Pump and Relief Valves

Figure 8:
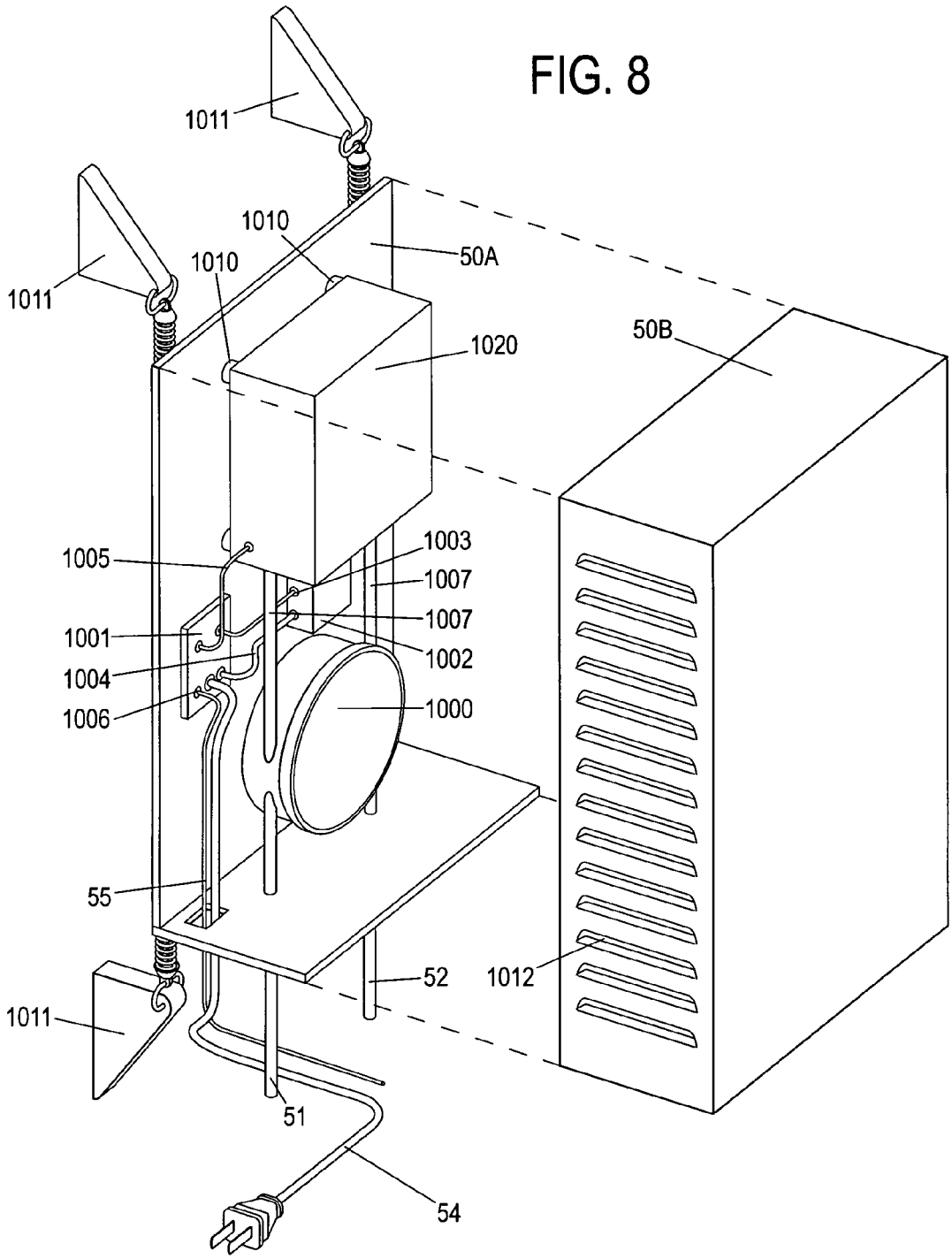
FIG. 8 shows one embodiment of the air pump enclosure and its mounting system.

FIG. 8 is a perspective view of the air pump enclosure 50 and its mounting system. The air pump 1020 has a vibrating armature that oscillates at the 60 Hz power line frequency. The preferred embodiment uses pump model 6025 from Thomas Pumps, Sheboygan, Wis. It produces noise that could be objectionable in some installations. The air pump is attached to the enclosure base 50A by four shock absorbing mounting posts 1010. The enclosure base is further isolated by using shock absorbing wall mounts 1011. The enclosure base and enclosure cover 50B are made of sound absorbing plastic to further isolate the noise. The enclosure cover has multiple small ventilation slots 1012.

The pump PCB (printed circuit board) 1001 and the 5V DC power supply 1002 are fastened to the enclosure base 50A. The pump PCB has a standard optically isolated triac circuit that uses a 5V binary signal from the control processor 60 to control the 110V AC power to the air pump. The pump PCB also has terminals to connect the 110V AC power cord 54, the AC supply to 5V power supply 1003, the 5V power from the supply 1004, and the controlled AC supply to the air pump 1005. The 3-conductor power and control cable 55 connects to the pump PCB by connector 1006.

The pressure and vacuum produced by the air pump are unregulated. A pair of diaphragm relief valves 1000 made from injected molded plastic are use to limit the pressure and vacuum to about 1 psi. The relief valves are connected to the air pump by flexible air tubes 1007 to provide noise isolation. The relief valves connect to the pressure air tube 51 and the vacuum air tube 52.

FIG. 9 shows several views of the relief valves 1000. FIG. 9A is a cross-section view through the section line shown in FIG. 9C. The main valve structure 1100 is a cylinder made of injection molded plastic. A plate 1101 divides the cylinder into a pressure cavity 1102 and a vacuum cavity 1103. The vacuum feed tube 1104 passes through pressure cavity and an air passage 1106 connects it to the vacuum cavity. Likewise, the pressure feed tube 1105 passes through the vacuum cavity and an air passage 1107 connects it to the pressure cavity. This arrangement enables the pressure feed tube 1105 and the vacuum feed tube 1104 to connect to the ports of the air pump with short and straight tubes.

Referring to FIG. 9A, a thin plastic diaphragm 1110 is glued to the rim of the relief valve structure 1100. The diaphragm has a hole in the center that is covered by the pressure plug 1111. As pressure increases in the pressure cavity 1102, the diaphragm is pushed away from the plug and air leaks from the pressure cavity. The leak increases as the pressure increases so the pressure is regulated. A threaded stud 1112 is mounted in the center of the divider 1101, and the pressure plug is threaded to match the stud.

Turning the pressure plug CW or CCW decreases or increases the force between the plug and the diaphragm, thus adjusting the relief pressure. A thin plastic diaphragm 1120 is glued to the rim of the relief valve structure 1100. The diaphragm has a hole in the center that is covered by the vacuum plug 1121. As vacuum increases in the vacuum cavity 1103, the diaphragm is pulled away from the plug and air leaks into the vacuum cavity. The leak increases as the vacuum increases so the vacuum is regulated. A threaded stud 1112 is mounted in the center of the divider 1101, and the vacuum plug is threaded to match the stud. Turning the vacuum plug CW or CCW increases or decreases the force between the plug and the diaphragm, thus adjusting the relief pressure. FIG. 9B is a full end view of the cross-section view shown in FIG. 9A.

FIG. 9C is a bottom view of the relief valves. The pressure air tube 51 connects to the pressure air feed 1105B and the pressure air feed 1105A connects to a flexible air tube 1007 that in turn connects to the pressure output of the air pump 1020. The vacuum air tube 52 connects to the vacuum feed tube 1104B and the vacuum feed tube 1104A connects to a second flexible air tube 1007 that in turn connects to the vacuum input of the air pump.

FIG. 9D is a cross-section view through the section line shown in FIG. 9B of the pressure cavity 1102. Air passage 1107 connects the pressure feed tube 1105 to the cavity. Air passage 1106 connects the vacuum feed tube 1104 to the vacuum cavity 1103.

System Installed on Plenum

Figure 10:
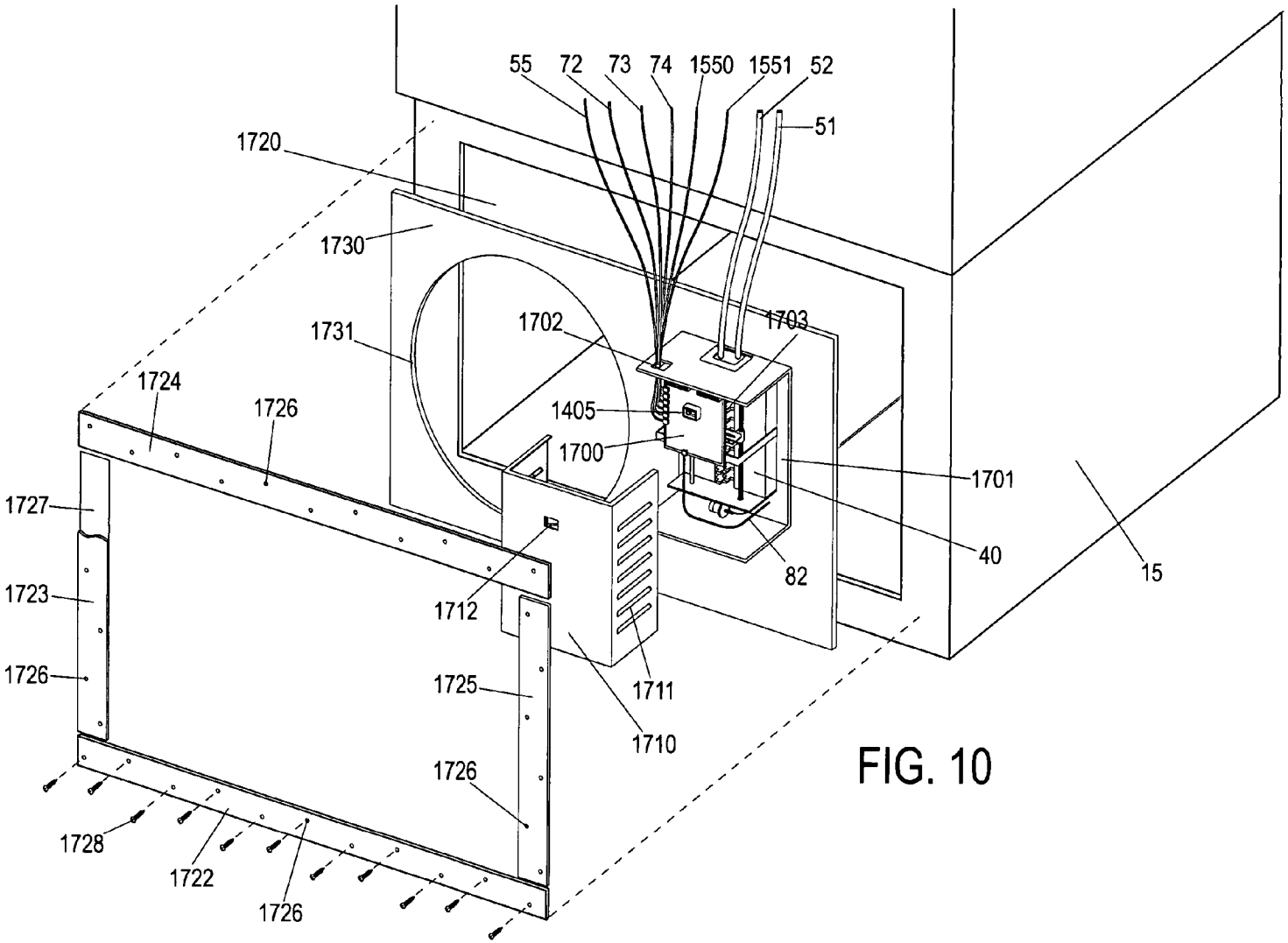
FIG. 10 shows the control processor printed circuit board mounted in the main enclosure according to one embodiment of this invention.

FIG. 10 is an exploded perspective view of the system components that are mounted on the conditioned air plenum 15. The control processor 60 and interface circuits are built on a PCB (printed circuit board) 1700 approximately 5"×5", which is mounted to the main enclosure base 1701. The PCB includes the terminals and sockets used to connect the control processor signals to the servo controlled air valves 40, the power and control connection 55, the temperature sensor 61, the pressure sensor 62, the radio receiver connection 72, the existing thermostat connection 73, the existing HVAC controller connection 74, the IrDA link connection 82, the RS232 connection 1551, and the remote connection 1550. Side 1703 of the main enclosure base 1701 has access cutouts and restraining cable clamps 1702 for the power and control connection 55, the radio connection 72, the existing thermostat connection 73, the existing HVAC controller connection 74, the RS232 connection 1551, and the remote connection 1550 (when used).

The main enclosure base 1701 has a cutout sized and positioned to provide clearance for the valve header 504 on the valve block 601 and valve block 602. The servo controlled air valve 40 as shown in FIG. 7 is mounted to the main enclosure base 1701. The main enclosure base also has cutouts for the pressure and temperature sensors to access the inside of the plenum and for the link connection 82 to pass from the plenum to its connector on the PCB 1700. The PCB is mounted above the air valve blocks. Side 1703 also has cutouts for the pressure air tube 51 and vacuum air tube 52 connected to the air-feed tee.

The main enclosure top 1710 fits to the base 1701 to form a complete enclosure. Vent slots 1711 in the main enclosure top provide ventilation. A cutout 1712 in the main enclosure top matches the location of switch 1405 on PCB 1700 so that when the main enclosure top is in position, the switch 1405 can be manually switched to either position.

To install the present invention, a hole 1720 approximately 16"×16" is cut in the side of the conditioned air plenum 15. The hole provides access for the process used to pull the air tubes 32 and to provide access when attaching the air tubes. The material removed to form the hole is made into a cover 1730 for the hole by attaching framing straps 1722, 1723, 1724, and 1725 to 1730. The framing straps are made from 20-gauge sheet metal approximately 2" wide. The mounting straps have mounting holes 1726 approximately every 4" and ¼" from each edge and have a thin layer of gasket material 1727 attached to one side. The straps are cut to length from a continuous roll, bent flat, and attached to the hole-material using sheet metal screws 1728 through the holes along the inside edge of the framing straps so that the framing straps extend approximately 1" beyond all edges of the hole-material. For clarity, only the screws used with framing strap 1722 are shown.

A rectangular hole is cut in the cover 1730 and is sized and positioned to match the cutouts in the bottom of the main enclosure base 1701 that provide clearance for the air valve headers and clearance for the pressure and temperature sensors and the link connection. The main enclosure base is fastened to the cover. After all connections from inside the plenum are made, the cover is attached to plenum using sheet metal screws through the holes along the outer edge of the framing straps. The gasket material on the mounting straps seals the mounting straps to the plenum and the cover 1730. When a bypass 90 is installed, it is often convenient to connect the bypass duct to the conditioned air plenum 15 through a hole 1731 in the cover 1730.

ADDITIONAL DESCRIPTION

The preceding material is substantially copied from the parent patent application (as typographically corrected in a preliminary amendment), and describes drawings (in some cases renumbered) present in the parent patent application. The following material describes additional drawings which are new to the present application. However, it should be noted that this does not automatically classify the following text nor the additional drawings as "new matter" for filing date purposes. Indeed, there is a substantial overlap in subject matter between the preceding material and the following material and between their respective drawings.

Figure 11:
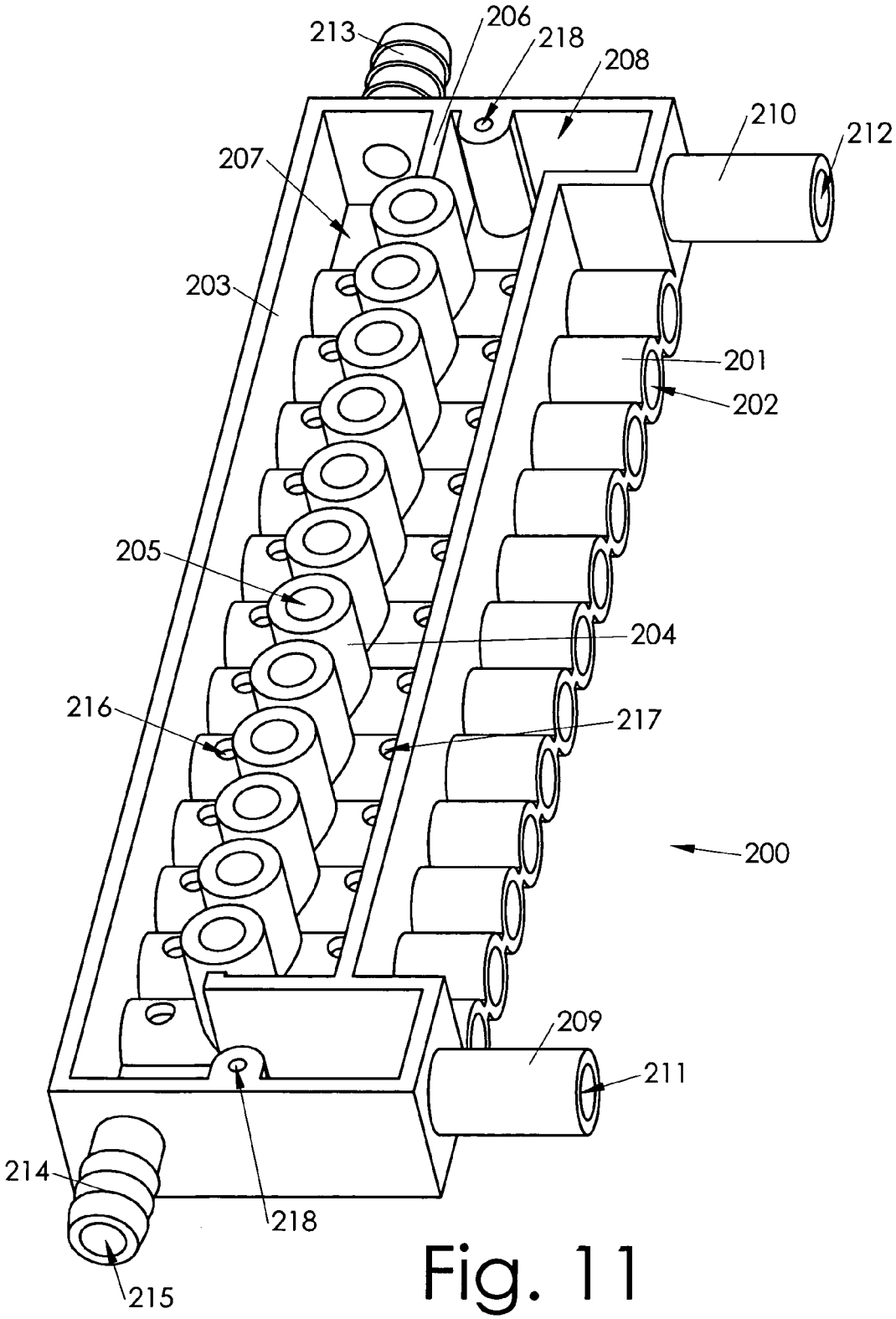
FIG. 11 shows another embodiment of a valve block or manifold.

FIG. 11 illustrates another embodiment of a valve block manifold 200 which is especially suitable for injection molded plastic manufacturing. The manifold includes a plurality of parallel valve cylinders 201 each including a bore 202. The valve cylinders form a substantially air-tight floor of the manifold. The manifold further includes vertical exterior walls 203 which are coupled to the floor.

A row of air tube connector cylinders 204 are coupled to respective ones of the valve cylinders, each including a bore 205 which is in communication with the bore of its corresponding valve cylinder. The air tube connector cylinders, together with a vertical interior wall 206, divide the interior of the manifold into first and second separate manifold chambers 207, 208. In some embodiments, the air tube connector cylinders extend slightly higher than the exterior and interior walls (obscuring the segments of the interior wall which are between adjacent pairs of air tube connector cylinders in the view illustrated).

First and second manifold connector cylinders 209, 210 are coupled to the exterior wall and include bores 211, 212 coupled through the exterior wall into communication with the first and second manifold chambers, respectively. The manifold connector cylinders are used to couple two manifolds into a manifold pair (not shown).

The manifold further includes first and second air supply connectors 213, 214 coupled to the exterior wall and having bores (not shown, and 215, respectively) extending into the first and second manifold chambers, respectively. The valve cylinders include first and second vent holes 216, 217 coupling their valve bores (and, more to the point, their respective air tube connector cylinders) to the first and second manifold chambers, respectively. Finally, the manifold may optionally include holes 218 or other suitable means for attaching a manifold cover (not shown).

Figure 12:
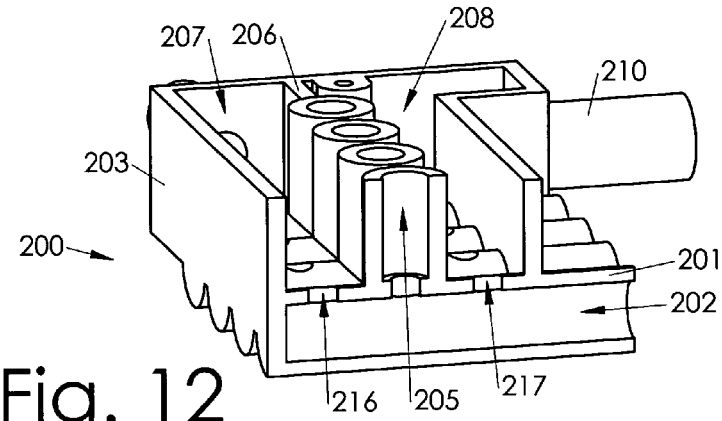
FIG. 12 shows a cutaway view of the manifold of FIG. 11.

FIG. 12 illustrates the manifold 200 with a cutaway for viewing the airflow communication between the valve bore 202, air tube connector bore 205, first manifold chamber vent 216, first manifold chamber 207, second manifold chamber vent 217, and second manifold chamber 208.

Figure 13:
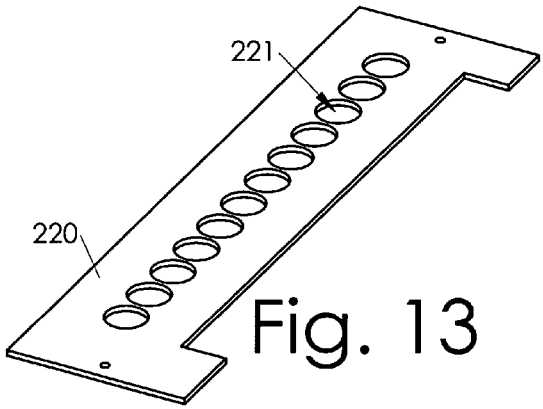
FIG. 13 shows one embodiment of a manifold cover.

FIG. 13 illustrates one embodiment of a manifold cover 220 such as may be used with the manifold of FIG. 11. The manifold cover includes holes 221 which mate with the air tube connector cylinders (204 of FIG. 11). In embodiments in which the manifold of FIG. 11 has air tube connector cylinders which extend higher than the interior and exterior walls, the holes 221 are sized to mate with the outer diameters of the air tube connector cylinders.

Figure 14:
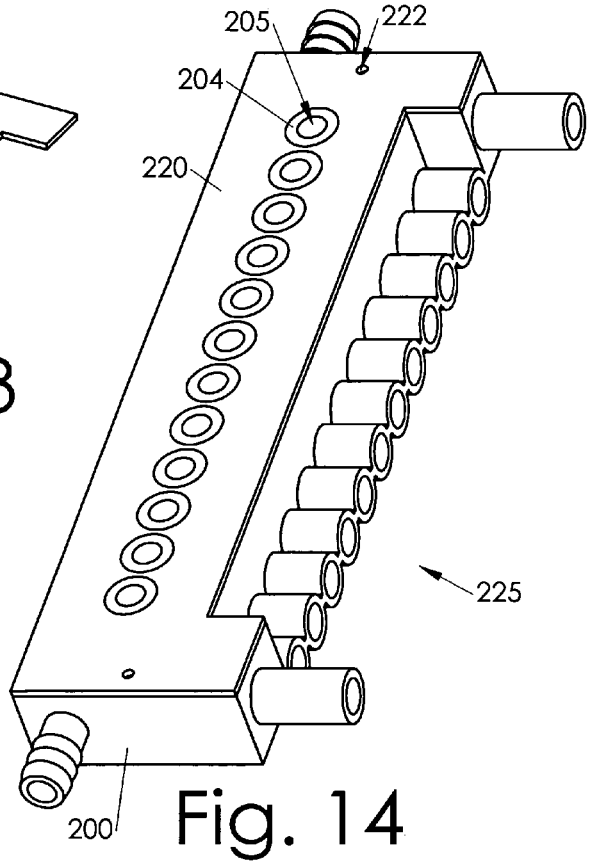
FIG. 14 shows a manifold assembly including the manifold of FIG. 11 and the manifold cover of FIG. 13.

FIG. 14 illustrates a manifold assembly 225 including a manifold 200 coupled in a substantially air-tight manner with a manifold cover 220. The bores 205 of the air tube connectors are exposed. As illustrated, the air tube connector cylinders 204 may also extend through the holes in the manifold cover. Although a variety of sealing mechanisms may be employed, such as gaskets, in one embodiment the manifold cover is simply glued to the manifold at all contact points, such as the exterior walls, interior divider wall, and air tube connector cylinders. In another embodiment, the manifold cover is manufactured with adhesive tape around its edges. A non-stick covering initially protects the adhesive. When mating the manifold cover to the manifold, the non-stick covering is removed and the adhesive tape is pressed around the edges of the manifold and adhered to its exterior walls. In some embodiments, it may be desirable to provide a more secure retention by screwing the manifold cover to the manifold with screws (not shown) placed in the holes 222.

Figure 15:
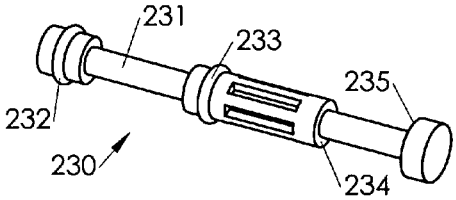
FIG. 15 shows another embodiment of a valve plunger according to this invention, suitable for use with the manifold assembly of FIG. 14.

FIG. 15 illustrates one embodiment of a valve plunger 230 such as may be used in conjunction with the manifold assembly of FIG. 14. The plunger includes a shaft 231 which is equipped with first and second seal such as o-rings 232, 233. In most embodiments (those in which a single-diameter valve cylinder bore (202 in FIG. 11) is employed), the outer diameter of the shaft will be less than the outer diameter of the seals.

The plunger further includes first and second actuator surfaces 234, 235 against which an actuator (not shown) can press to respectively insert and withdraw the valve plunger in the manifold.

Figure 16:
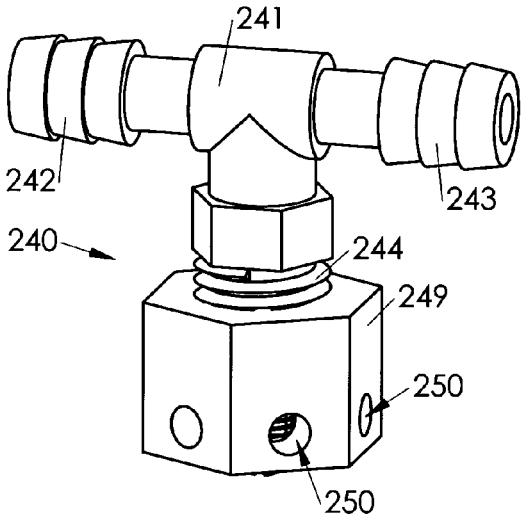
FIG. 16 shows another embodiment of a pressure relief valve.
Figure 17:
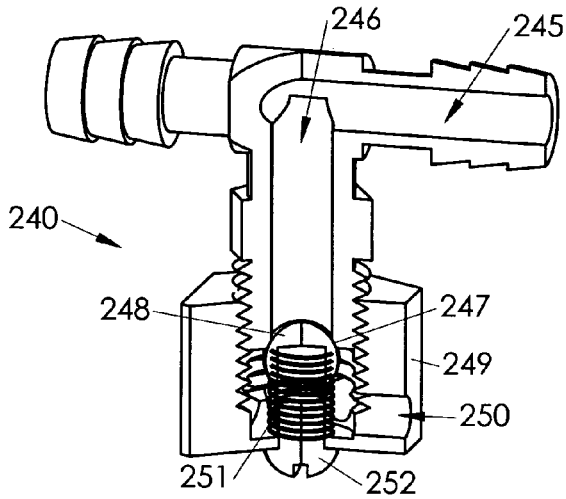
FIG. 17 shows the pressure relief valve in cutaway.

FIGS. 16 and 17 illustrate another embodiment of a pressure relief valve 240 such as may be employed with the manifold system, and which is easily and cheaply manufactured mainly using off-the-shelf components. The pressure relief valve is built upon a standard plastic T fitting 241 used for coupling plastic tubing to threaded pipe. The T fitting has coaxial barbed connectors 242, 243 and a perpendicular male threaded connector 244. The bore 245 of the barbed connectors is in communication with the bore 246 of the threaded connector. The T fitting may optionally be modified by cutting or otherwise forming a suitably shaped seat 247 at the terminal end of the bore 246 to form an improved airtight fit with a check ball 248 which is larger than the bore 246. In another embodiment, an o-ring is positioned to form an airtight seal with a check ball.

A female threaded pipe cap fitting 249 is modified with one or more vent holes 250 which are, after the cap is threaded onto the T fitting, in airflow communication with the bore 246. A spring 251 holds the check ball against the seat 247 under sufficient force to provide the desired pressure relief setting. This setting is grossly determined by the strength of the spring, and can be finely adjusted according to how far the cap is screwed onto the T fitting. In some embodiments, the cap end of the spring may be positively located by a screw or bolt 252 extending through the bottom of the cap. In some embodiments, the ball end of the spring may be positively located by an axial bore extending part way into the check ball. Alternatively, the ball end of the spring may be embedded directly in the check ball during manufacturing of the check ball. In another embodiment, an adhesive is used to attach the spring to the check ball and/or to the bottom of the cap. The check ball is not necessarily spherical in all embodiments.

In operation, if the air pressure within the bore 246 becomes too great, the check ball will be forced away from the seat, and air will escape out the holes 250.

Figure 18:
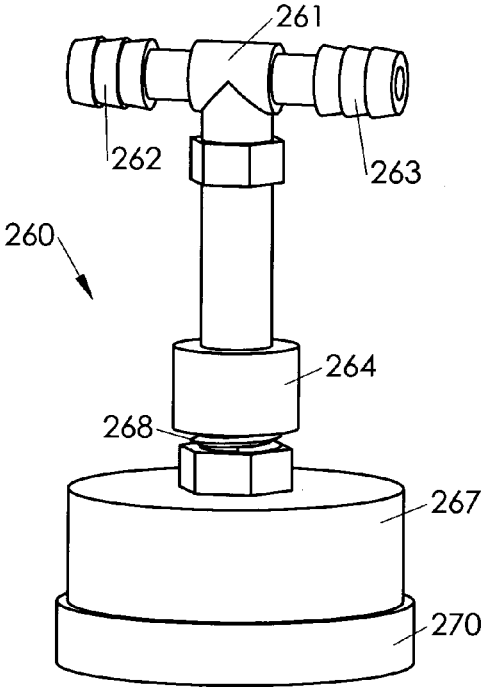
FIG. 18 shows another embodiment of a vacuum relief valve.
Figure 19:
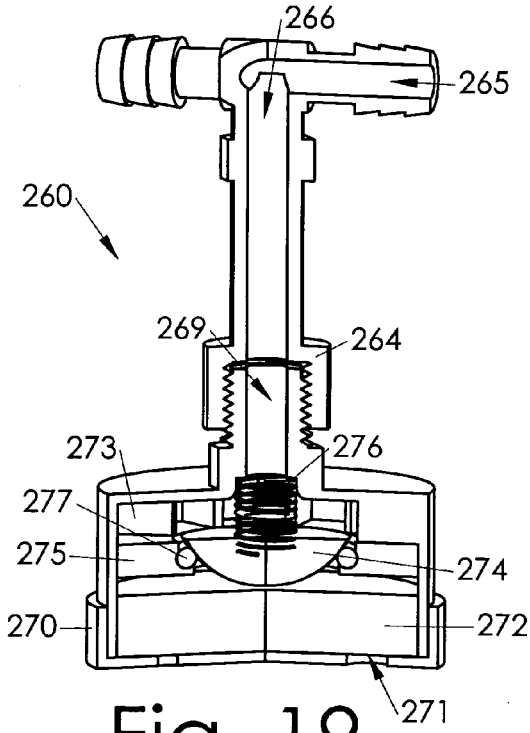
FIG. 19 shows the vacuum relief valve in cutaway.

FIGS. 18 and 19 illustrate another embodiment of a vacuum relief valve 260 which is easily and cheaply made mostly from off-the-shelf components. The vacuum relief valve is built upon a plastic T fitting 261 such as is commonly used to connect plastic tubing to threaded pipe. The T fitting includes coaxial barbed connectors 262, 263 and a perpendicular female threaded connector 264. The bore 265 of the coaxial connectors is in airflow communication with the bore 266 of the perpendicular connector.

A commercially available plastic air compressor filter 267 includes a male threaded connector 268 which is screwed into the T fitting such that a bore 269 of the filter is in airflow communication with the bore 266. The filter includes a removable cap 270 which is provided with holes 271 which are in airflow communication through a foam filter element 272 to the bore 269. The filter includes stand-offs 273 originally intended to prevent the filter from coming into direct contact with the bore 269 (which would tend to force all flow through a relatively small volume of the filter immediately adjacent the bore, increasing the filter's flow resistance and reducing the time required between cleanings). The filter is modified with the addition of an insert 275 that divides the air filter cavity into two volumes, and supports an o-ring 277. A check ball 274 is held against the o-ring by a spring 276. In some embodiments, the cost of the insert can be reduced by providing it with a smooth surface against which the check ball mates, eliminating the need for an o-ring. In some embodiments, the original foam filter element is replaced by a filter element made from thinner material, so the filter element does not interfere with the check ball.

In operation, if the vacuum within the bore becomes to strong, the external ambient pressure will force the check ball away from the seal, and air will flow into the bore 269.

In single-manifold embodiments, L fittings or even straight fittings, rather than T fittings, can be used in constructing the pressure and vacuum relief valves.

Figure 20:
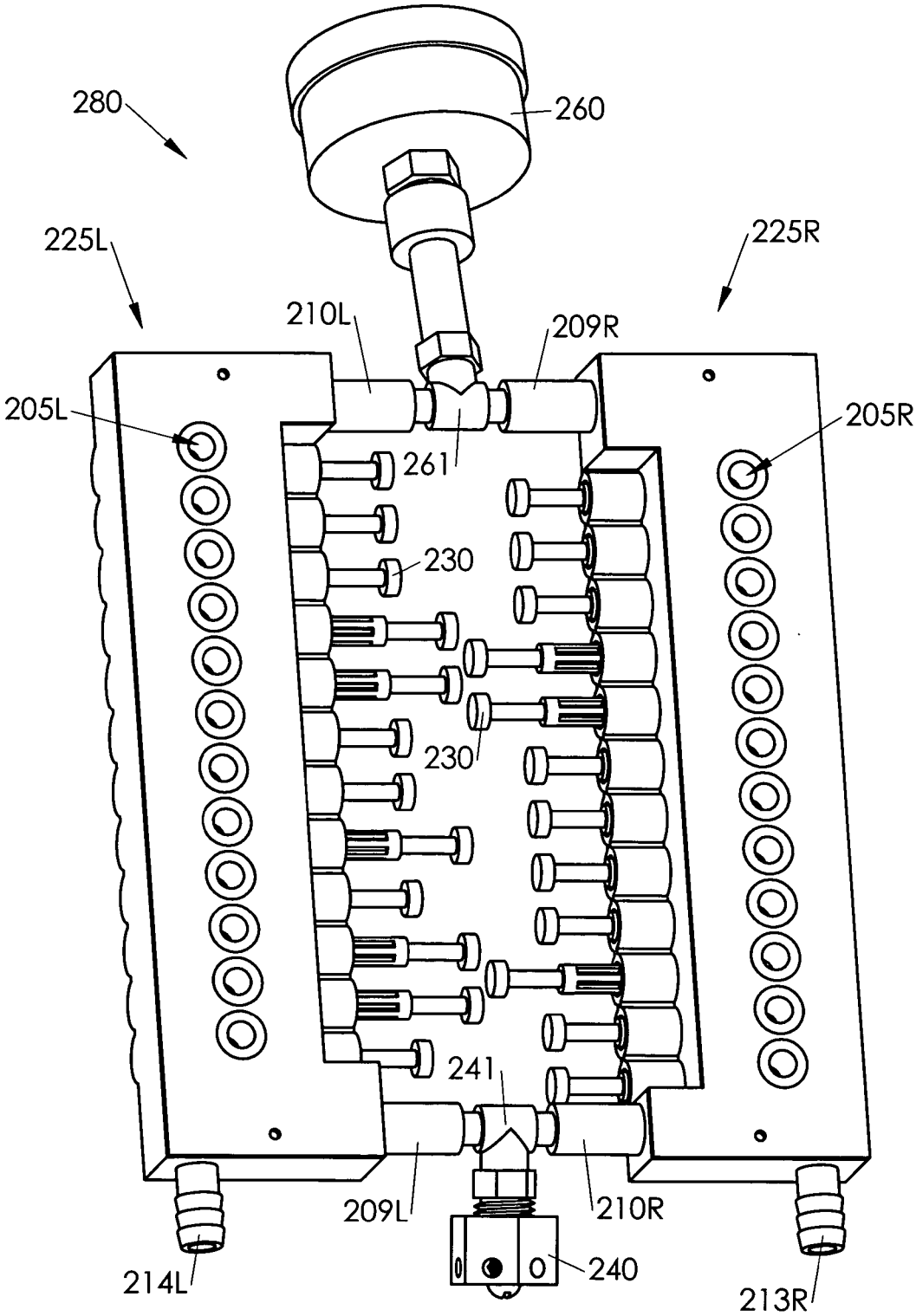
FIGS. 20 and 21 shows a completed valve assembly according to another embodiment of this invention.
Figure 21:
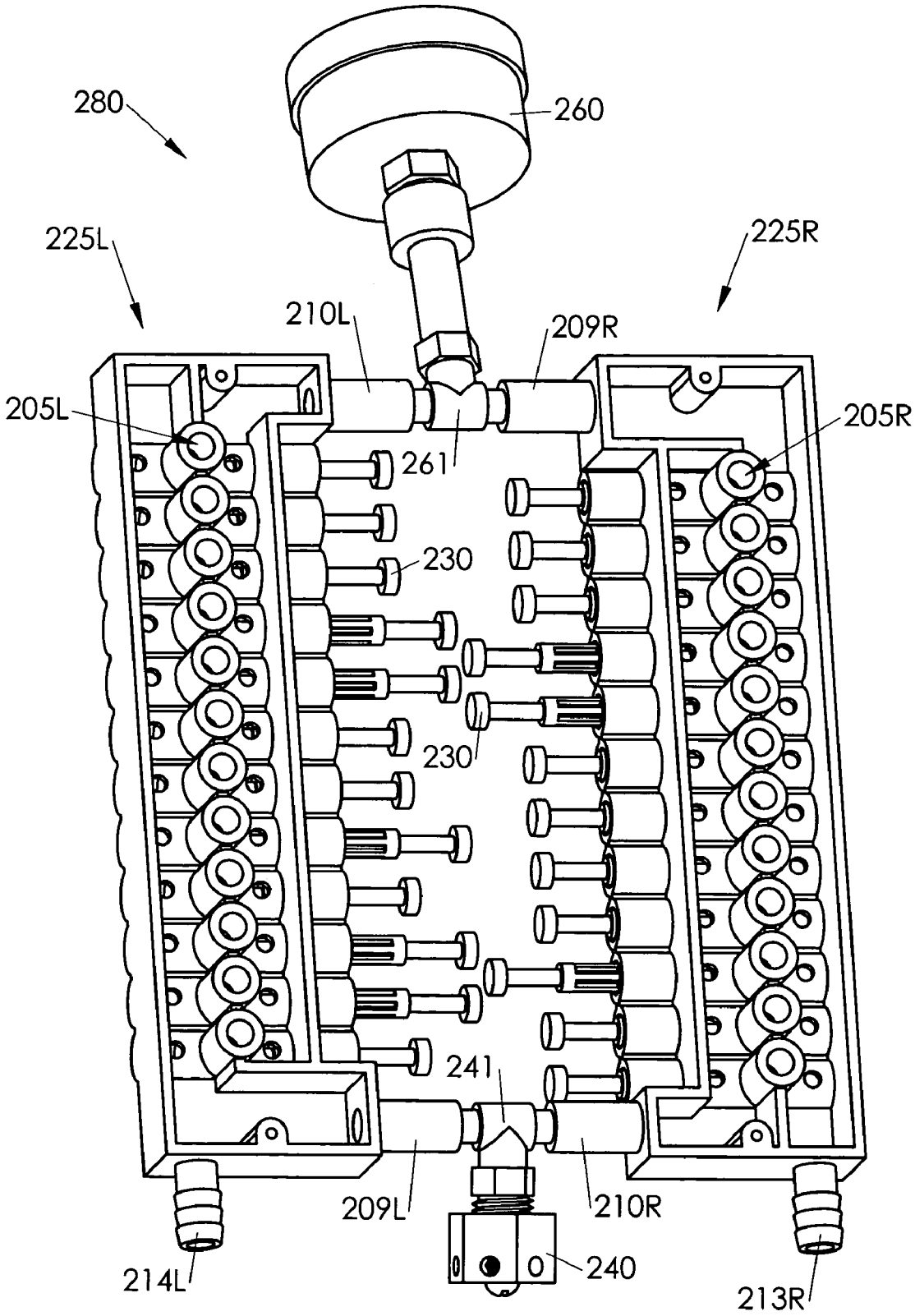

FIGS. 20 and 21 illustrate the components of FIGS. 11–19 assembled into a valve manifold assembly 280. The assembly includes a pair of manifold assemblies 225L, 225R. The left manifold assembly 225L is substantially as shown in FIG. 14, while the right manifold assembly 225R is another unit of the same assembly, rotated 180° about an axis extending generally out of the page. The first manifold connector 209L of the left manifold is coupled by the T fitting 241 of the pressure relief valve 240 to the second manifold connector 210R of the right manifold. Because of the 180° rotation of the right manifold assembly, the second manifold connector provides airflow communication between the first manifold chamber (207 in FIG. 11) of the left manifold assembly 225L and the second manifold chamber (208 in FIG. 11) of the right manifold assembly 225R. Thus, the "left" manifold chambers are connected together into one large pressure chamber spanning both manifold assemblies. Similarly, the second manifold connector 210L of the left manifold is coupled by the T fitting 261 of the vacuum relief valve 260 to the first manifold connector 209R of the right manifold, providing airflow communication between the second manifold chamber of the left manifold assembly and the first manifold chamber of the right manifold assembly. Thus, the "right" manifold chambers are connected together into one large vacuum chamber spanning both manifold assemblies.

Pressure is applied by the pump (not shown) to the "left" pressure chamber via connector 214L. Air flows from the connector 214L directly into the first manifold chamber (207) of the left manifold assembly, and through the pressure relief valve's T fitting 241 into the second manifold chamber (208) of the right manifold assembly.

Vacuum is applied by the pump to the "right" vacuum chamber via connector 213R. Air flows from the second manifold chamber (208) of the left manifold assembly, through the vacuum relief valve's T fitting 261 into the first manifold chamber (207) of the right manifold assembly, and out the connector 213R.

When a plunger in the left manifold assembly is in its leftmost, "IN" position, the air tube connector 205L is in airflow communication with the second manifold chamber (208) of the left manifold assembly—the "left" chamber—and vacuum is applied to the air tube connector. When a plunger in the left manifold assembly is in its rightmost, "OUT" position, the air tube connector is in airflow communication with the first manifold chamber (207), and pressure is applied to the air tube connector.

Likewise, when a plunger in the right manifold assembly is in its rightmost, "IN" position, the air tube connector 205R is in airflow communication with the first manifold chamber (207) of the right manifold assembly—the "left" chamber"—and vacuum is applied to the air tube connector. When a plunger in the right manifold assembly is in its leftmost, "OUT" position, the air tube connector is in airflow communication with the second manifold chamber (208), and pressure is applied to the air tube connector.

Thus, the plunger positions can be characterized as: "left" provides vacuum, and "right" provides pressure. (Because the right manifold assembly is 180° rotated, it cannot be said that "in" nor "out" has a consistent meaning.)

In one embodiment, as shown, the other two connectors (which would be 213 of the left manifold and 214 of the right manifold, if shown) may be removed, as they are not needed. In some such embodiments, their bore holes are then plugged; in other such embodiments, the bore holes are not formed at manufacturing time, and are formed for the connectors 214L and 213R at assembly time, avoiding the necessity of plugging any holes.

In one embodiment, the T fittings of the relief valves are press fit into the manifold connector cylinders without the use of adhesives or other fastening methods. The press fit between the T fitting barbs and the insides of the cylinders provides a sufficiently airtight coupling, maintains proper spacing between the left and right manifold assemblies, and mechanically secures the components together as a single unit. In other embodiments, it may be desirable to use other fastening means.

Figure 22:
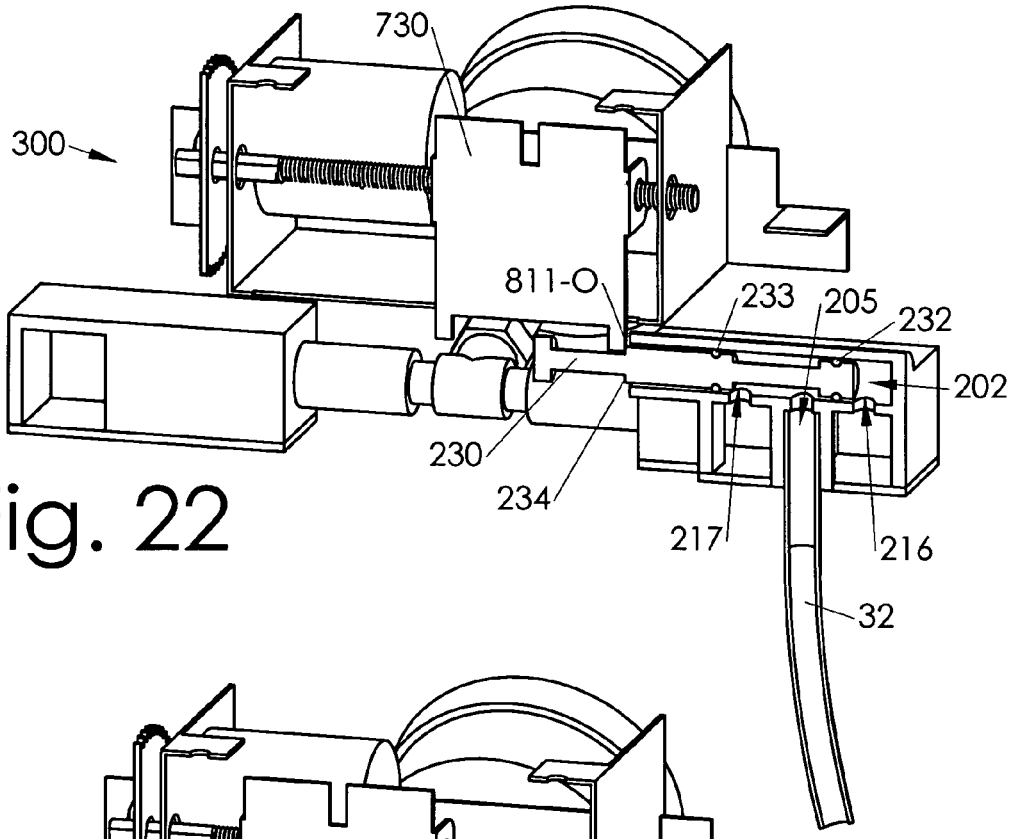
FIGS. 22 and 23 show a cross-section view of the actuator moving a manifold valve to the in and out positions, respectively.

FIG. 22 illustrates, in cross-section view with various components removed for clarity, another embodiment of the valve actuator system 300 suitable for use with the valve manifold. Relative to FIG. 20, the assembly has been rotated 180 degrees about a longitudinal centerline (running generally from the top of the page to the bottom) and cut away such that only an uppermost valve assembly is visible (the top left valve in FIG. 20). Note that, while FIG. 20 illustrates the "back" side of the manifold assembly, or the side which is placed adjacent the plenum (not shown) to receive the air tubes which extend from the bladders (not shown), FIG. 21 illustrates the "top" side of the manifold assembly.

The manifold assembly includes a valve plunger 230 riding in a valve cylinder bore 202. An outer edge 811-O of a slider finger 811 of a servo slider 730 pushes on the first actuator surface 234 of the plunger until the first seal 232 is between the bore 205 and the vent 216. This is the "IN" position. In this position, the bore 205 is in airflow communication (around the shaft of the plunger) with the vent 217, coupling the air tube 32 to the "right" manifold chamber (remember that FIG. 21 is flipped with respect to FIG. 20) which will be placed under vacuum once all the plungers are in their correct positions. In this position, the first seal 232 also prevents airflow communication from the "left" manifold chamber both to the bore 205 and to the vent 217.

Figure 23:
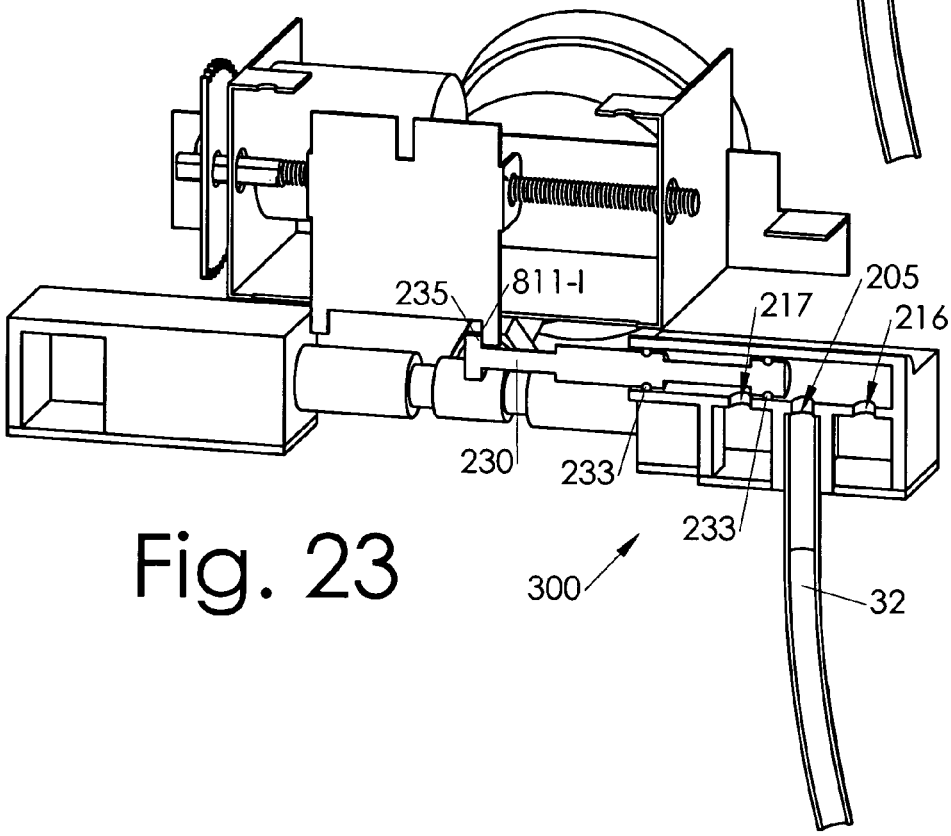

FIG. 23 illustrates, in cross-section, the inner edge 811-I of the slider finger pushing on the second actuator surface 235 of the plunger 230 until the seal 232 is between the bore 205 and the vent 217. This is the "OUT" position. In this position, the bore 205 is in airflow communication with the vent 216, coupling the air tube 32 to the "left" manifold chamber which will be placed under pressure once all the plungers are in their correct positions. In this position, the seal 232 also prevents airflow communication from the "right" manifold chamber both to the bore 205 and to the vent 216.

CONCLUSION

While the invention has been described with reference to air pressure and vacuum, the skilled reader will readily appreciate that it may be adapted for use with other fluids such as water or hydraulic fluid. And while the invention has been described with respect to pressure and vacuum, the skilled reader will readily appreciate that it may be adapted for use with two different pressure levels, or two different vacuum levels. And while the invention has been described with reference to the same ambient—air—being provided under pressure and vacuum, two different fluid flows could be controlled with the two separate manifold chambers, such as air vacuum and water pressure, or salt water and fresh water, or Coke and Pepsi, or what have you. Furthermore, although the invention has been described with reference to embodiments which are suitable for use in relatively low pressure and low vacuum applications, such as the meager 1 psi or so believed necessary for operating pneumatic bladders, it could readily be practiced in much higher pressure environments and constructed of much higher strength materials than e.g. injection molded plastic.

Although the valve system has been described as providing selective connection to one of two manifolds, it could be enhanced for use with three or more manifolds, albeit at the cost of a perhaps significantly increased manufacturing complexity for both the manifold and valve plunger components.

When one component is said to be "adjacent" another component, it should not be interpreted to mean that there is absolutely nothing between the two components, only that they are in the order indicated. The various features illustrated in the figures may be combined in many ways, and should not be interpreted as though limited to the specific embodiments in which they were explained and shown. Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An apparatus comprising:

a first manifold chamber;

a first manifold connector having a bore in communication with the first manifold chamber;

a second manifold chamber substantially sealed from the first manifold chamber;

a second manifold connector having a bore in communication with the second manifold chamber; and a plurality of valve cylinders each having, a valve bore open at one end thereof, a first vent connecting the valve bore to the first manifold chamber, a second vent connecting the valve bore to the second manifold chamber, and a valve connector having a bore connected to the valve bore.

2. The apparatus of claim 1 further comprising:

a plurality of valve plungers each disposed within a valve bore of a respective one of the valve cylinders.

3. The apparatus of claim 2 wherein the valve plunger comprises:

a shaft;

a first seal coupled to the shaft and forming a substantially sealed coupling to the valve bore;

a second seal coupled to the shaft and forming a substantially sealed coupling to the valve bore;

a portion of the shaft between the first and second seals having a smaller diameter than the valve bore;

the first and second seals being disposed along the shaft a predetermined distance apart which is greater than a distance between the connector bore and one of the first and second vent.

4. The apparatus of claim 1 comprising:

a manifold body in which the first and second manifold chambers are formed; and a manifold cover coupled to the manifold body to seal the first and second manifold chambers from an external ambient, the manifold cover including a plurality of holes extending through the manifold cover for providing access to the valve connector bores.

5. The apparatus of claim 4 wherein:

the valve connectors extend through the manifold cover; and the holes through the manifold cover mate with external dimensions of the valve connectors.

6. The apparatus of claim 1 further comprising:

first and second substantially identical manifolds coupled together in a substantially "yin and yang" configuration.

7. The apparatus of claim 6 wherein:

the first manifold chamber of the first manifold is coupled to the second manifold chamber of the second manifold, forming a first single large manifold chamber;

the second manifold chamber of the first manifold is coupled to the first manifold chamber of the second manifold, forming a second single large manifold chamber.

8. The apparatus of claim 7 further comprising:

a first T fitting coupling a first manifold connector of the first manifold to a second manifold connector of the second manifold.

9. The apparatus of claim 8 further comprising:

a second T fitting coupling a second manifold connector of the first manifold to a first manifold connector of the second manifold.

10. The apparatus of claim 9 further comprising:

one of a pressure relief valve and a vacuum relief valve coupled to one of the first and second T fittings.

11. The apparatus of claim 10 further comprising:

the other of a pressure relief valve and a vacuum relief valve coupled to the other of the first and second T fittings.

12. The apparatus of claim 6 further comprising:

a plurality of valve plungers each disposed within a respective one of the valve cylinder bores of the first and second manifolds.

13. The apparatus of claim 12 wherein:

the valve cylinders of the first manifold and the valve cylinders of the second manifold are substantially one half valve cylinder increment offset with respect to each other.

14. The apparatus of claim 6 further comprising:

the first manifold having a first coupler in communication with its first manifold chamber; and the second manifold having a second coupler in communication with its first manifold chamber.

15. The apparatus of claim 14 wherein:

a second coupler of the first manifold and a first coupler of the second manifold having been removed after manufacturing of the substantially identical manifolds.

16. The apparatus of claim 15 wherein:

the first coupler of the first manifold and the second coupler of the second manifold having been put into communication with their respective manifold chambers after manufacturing of the substantially identical manifolds.

17. The apparatus of claim 1 wherein:

the first and second manifold chambers are divided by an interior wall including the valve connectors.

18. The apparatus of claim 1 wherein:

the apparatus is formed by injection molding plastic.

19. The apparatus of claim 1 wherein:

the valve cylinders comprise a floor of the apparatus.

20. A pressure and vacuum manifold assembly comprising:

A) a first manifold and a second manifold, each including, 1) a first manifold chamber, 2) a second manifold chamber, 3) a plurality of valve connector cylinders separating the first and second manifold chambers, 4) a plurality of valve cylinders each having, i) a bore, ii) a first vent connecting the first manifold chamber to the bore, iii) a second vent connecting the second manifold chamber to the bore, and iv) a third vent connecting the bore to a corresponding one of the valve connector cylinders, B) a first manifold connector coupling the first manifold chamber of the first manifold to the second manifold chamber of the second manifold;

C) a second manifold connector coupling the second manifold chamber of the first manifold to the first manifold chamber of the second manifold;

D) a first supply connector providing flow access to the first manifold chamber of the first manifold, and via the first manifold connector to the second manifold chamber of the second manifold; and E) a second supply connector providing flow access to the first manifold chamber of the second manifold, and via the second manifold connector to the second manifold chamber of the first manifold;

whereby pressure can be applied to one of the supply connectors and fed to both manifolds and vacuum can be applied to the other supply connector and fed to both manifolds.

21. The pressure and vacuum manifold assembly of claim 20 further comprising:

a plurality of valve plungers each disposed within a respective one of the valve cylinder bores.

22. The pressure and vacuum manifold assembly of claim 21 wherein the valve plunger comprises:

a shaft extending out an open end of the valve cylinder bore;

a first seal coupled to the shaft at a first position;

a second seal coupled to the shaft at a second position such that when the first seal is located between the first vent and third vent, the second seal is located between the second vent and the open end of the valve cylinder bore.

23. The pressure and vacuum manifold assembly of claim 22 wherein the valve plunger further comprises:

a first actuator surface against which an actuator can push to insert the valve plunger into the valve cylinder bore; and a second actuator surface against which an actuator can pull to withdraw the valve plunger from the valve cylinder bore.

24. The pressure and vacuum manifold assembly of claim 21 further comprising:

a pressure relief valve coupled to one of the manifold connectors; and a vacuum relief valve coupled to the other manifold connector.

25. The pressure and vacuum manifold assembly of claim 21 wherein:

the valve plungers of the first manifold and the valve plungers of the second manifold can all be placed in a retracted position without interfering with each other.

26. The pressure and vacuum manifold assembly of claim 20 wherein:

the valve cylinder bores of the first manifold and the valve cylinder bores of the second manifold are oriented toward each other in a middle of the pressure and vacuum manifold assembly.

27. The pressure and vacuum manifold assembly of claim 20 wherein:

the first and second manifolds comprise two substantially identical units of a single manufactured component.

28. The pressure and vacuum manifold assembly of claim 27 wherein:

the single manufactured component includes two supply connectors;

one of the supply connectors is removed from the first manifold to leave the first supply connector; and the other of the supply connectors is removed from the second manifold to leave the second supply connector.

29. The pressure and vacuum manifold assembly of claim 27 wherein:

each manifold includes a first connector cylinder in communication with its first manifold chamber and a second connector cylinder in communication with its second manifold chamber;

the first manifold connector connects the first connector cylinder of the first manifold to the second connector cylinder of the second manifold; and the second manifold connector connects the second connector cylinder of the first manifold to the first connector cylinder of the second manifold.

30. A dual chamber manifold comprising:

an exterior wall;

a plurality of valve cylinders, forming a floor coupled to the exterior wall;

a cover coupled to the exterior wall, whereby a volume is enclosed within a space created by the exterior wall, the floor, and the cover; and a corresponding plurality of connector cylinders coupled to and substantially perpendicular to the valve cylinders, and coupled to the cover, forming an interior wall dividing the enclosed volume into a first manifold chamber and a second manifold chamber.

31. The dual chamber manifold of claim 30 further comprising:

a plurality of valve plungers disposed within the valve cylinders, each individually operable to selectively couple its respective connector cylinder to each, one at a time, of the first and second manifold chambers.

32. The dual chamber manifold of claim 31 further comprising:

two such dual chamber manifolds coupled together such that one of the first and second manifold chambers of each dual chamber manifold is coupled to one of the first and second manifold chambers of the other dual chamber manifold, and the other of the first and second manifold chambers of each dual chamber manifold is coupled to the other of the first and second manifold chambers of the other dual chamber manifold.

33. The dual chamber manifold of claim 32 wherein:

the two dual chamber manifolds are of substantially identical construction and are coupled together in yin and yang fashion.

34. The dual chamber manifold of claim 33 wherein:

first manifold chamber of the first manifold is coupled to the second chamber manifold of the second manifold, forming a first large manifold;

the second manifold chamber of the first manifold is coupled to the first chamber manifold of the second manifold, forming a second large manifold;

a single common pressure connector feeds the first large manifold; and a single common vacuum connector feeds the second large manifold.

* * * * *